US010755907B2

(12) United States Patent
Aizikov et al.

(10) Patent No.: US 10,755,907 B2
(45) Date of Patent: Aug. 25, 2020

(54) METHOD OF PRODUCING A MASS SPECTRUM

(71) Applicant: Thermo Fisher Scientific (Bremen) GmbH, Bremen (DE)

(72) Inventors: Konstantin Aizikov, Bremen (DE); Dmitry Grinfeld, Bremen (DE); Alexander Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 680 days.

(21) Appl. No.: 15/131,300

(22) Filed: Apr. 18, 2016

(65) Prior Publication Data

US 2016/0314951 A1 Oct. 27, 2016

(30) Foreign Application Priority Data

Apr. 24, 2015 (EP) ..... 15165127
Apr. 5, 2016 (EP) ..... 16163872

(51) Int. Cl.
*H01J 49/00* (2006.01)
*H01J 49/10* (2006.01)
(Continued)

(52) U.S. Cl.
CPC ..... *H01J 49/0036* (2013.01); *H01J 49/10* (2013.01); *H01J 49/38* (2013.01); *H01J 49/425* (2013.01)

(58) Field of Classification Search
CPC ..... H01J 49/0036; H01J 49/10; H01J 49/38; H01J 49/425
(Continued)

(56) References Cited

U.S. PATENT DOCUMENTS 8,399,827 B1 3/2013 Grothe
8,431,886 B2 4/2013 Grothe, Jr.
(Continued)

FOREIGN PATENT DOCUMENTS

CN 104303258 A 1/2015

OTHER PUBLICATIONS

Duarte et al., "Spectral compressive sensing", Appl. Comput. Harmon. Anal. 35 (2013), pp. 111-129.
(Continued)

*Primary Examiner* — Dzung Tran
(74) *Attorney, Agent, or Firm* — David A. Schell

(57) ABSTRACT

A method of producing a mass spectrum from a time-varying transient signal detected in a mass spectrometer, the method comprising: performing a Fourier transform of the transient signal to produce a first set of complex amplitudes wherein each of the complex amplitudes corresponds to a respective frequency of a first set of frequencies; generating a second set of complex amplitudes, wherein each of the complex amplitudes corresponds to a respective frequency of a second set of frequencies with a minimum spacing less than the inverse of the duration of the transient signal; optimizing the second set of complex amplitudes to produce an improved second set; generating a mass spectrum from at least some of the improved second set of complex amplitudes; wherein optimizing the second set of complex amplitudes to produce an improved second set of complex amplitudes is based on an objective function subject to some phase constraints.

26 Claims, 17 Drawing Sheets

(51) Int. Cl.
*H01J 49/38* (2006.01)
*H01J 49/42* (2006.01)

(58) Field of Classification Search
USPC ..... 702/189
See application file for complete search history.

(56) References Cited

U.S. PATENT DOCUMENTS

| | | | | |
|---|---|---|---|---|
| 8,853,620 | B2 | 10/2014 | Lange | |
| 2009/0278037 | A1 | 11/2009 | Grothe, Jr. | |
| 2010/0258714 | A1* | 10/2010 | Makarov ..... | H01J 49/0009 250/281 |
| 2011/0240841 | A1 | 10/2011 | Lange | |
| 2013/0311110 | A1 | 11/2013 | Aizikov et al. | |

OTHER PUBLICATIONS

Sacchi et al., "Interpolation and Extrapolation Using a High-Resolution Discrete Fourier Transform", IEEE Transactions on Signal Processing, vol. 46, No. 1, (1998), pp. 31-38.

* cited by examiner

METHOD OF PRODUCING A MASS SPECTRUM

TECHNICAL FIELD OF THE INVENTION

The present invention relates to a method of producing a mass spectrum from a time-varying transient signal detected in a mass spectrometer.

BACKGROUND TO THE INVENTION

One of the primary goals of Fourier Transform Mass Spectrometry (FTMS) is the identification of the ionic species, along with their relative abundances present, in a form of coherently oscillating ion packets contained by the trapping field within a mass spectrometer. The frequency of oscillation of a coherent packet of ions is a function of the mass to charge (m/z) ratio of the ionic species and is referred to herein as the "characteristic frequency" of an ionic species. The trapping field can be provided by the combination of an electrostatic field and a magnetostatic field, for example in a Fourier Transform Ion Cyclotron Resonance (FTICR) mass analyzer, or by an electrostatic field only, for example in an ORBITRAP mass analyzer. FTMS using RF fields is also known.

Typically, ions are detected by an image current S(t) (also termed a continuous transient image current and herein referred to as the "transient") induced on detection electrodes of the mass analyzer as the oscillating ions pass nearby. Therefore, the transient comprises a superposition of one or more periodic signals. Each periodic signal corresponds to the oscillation of a respective coherent packet of ions within the mass analyzer with a respective characteristic frequency. The transient is only measured (or captured or recorded) over a finite time T, termed the "duration" of the transient.

The transient processing usually involves discrete Fourier transform (DFT), which decomposes the transient into a number of periodic functions (also termed Fourier basis functions). Each Fourier basis function is localized at a respective frequency (also termed a Fourier Transform bin). The frequencies corresponding to the Fourier basis functions form a set of frequencies (referred to as the Fourier grid). The Fourier basis functions are equally spaced in the frequency domain i.e. the separation between adjacent frequencies is a constant. In particular, the separation between adjacent frequencies in the set of frequencies (herein referred to as the "separation" of the set of frequencies) is determined by the inverse of the duration of the transient 1/T. The decomposition comprises calculating, based on the transient, individual complex amplitudes corresponding to each Fourier basis function. Thereby a set of complex amplitudes is formed. Therefore, the discrete Fourier transform (DFT) represents the transient in the frequency domain. In particular, the transient is represented as a set of complex amplitudes. Each complex amplitude of the set of complex amplitudes corresponds to a respective frequency of the set of frequencies i.e. the frequency at which the corresponding Fourier basis function is localized.

The periodic signals present in the transient (as described previously) are related to the complex amplitudes. In particular, the periodic signal will contribute to the complex amplitudes corresponding to a plurality of frequencies in the set of frequencies. The plurality of frequencies will be substantially centred on the characteristic frequency of a particular ionic species for given experimental conditions. Therefore a plot of the set of complex amplitudes against the set of frequencies (referred to as a mass spectrum) will show one or more peaks, each peak substantially centred on a respective characteristic frequency present in the transient i.e. the centroid of each peak will be substantially equal to the characteristic frequency.

As described above, the frequencies of the periodic signals present in the transient are a function of the m/z ratios of the ionic species. Therefore, the centroid of each peak can be converted (or transformed or interpreted) into a respective m/z ratio thereby identifying a respective ionic species. Furthermore the height of each peak can be converted (or transformed or interpreted) into the respective relative abundance of the respective ionic species.

Due to the spacing of frequencies in the Fourier grid, determining the centroids of the peaks, and/or the heights of the peaks can be subject to errors. These errors lead to errors in the estimation of correct m/z ratios (and therefore ionic species being identified incorrectly) along with errors in the estimation of relative abundances. These errors can be particularly significant when the difference between a characteristic frequency present in the transient and the closest frequency in the set of frequencies is large.

A number of approaches aimed at apparent "smoothing" of spectra (hence potentially reducing the estimation errors) currently employed include interpolating the complex amplitudes onto a further set of frequencies with reduced separation between frequencies i.e. interpolating the mass spectrum. The most common interpolation method is zero-padding (see Marshall A. G.; Verdun, F. R., "Fourier Transforms in NMR, Optical, and Mass Spectrometry", Elsevier, 1990, the entire contents of which are incorporated herein by reference). Zero padding, if done explicitly, comprises of appending the transient by zero-signal of a predetermined duration resulting in an artificial increase of the transient duration and, correspondingly a decrease in the separation of the set of frequencies. Therefore, if the transient duration is increased by a factor P through the appending of a zero-signal, the separation of the set of frequencies is correspondingly reduced by a factor P. Due to the mechanics of implementation of Fast Fourier Transform (FFT), the most common algorithm for computing DFT, it is common for P to be a power of two and the interpolated mass spectrum is called $\log_2$ P-times zero-padded.

Whilst this can reduce the errors described above in relation to isolated peaks corresponding to respective characteristic frequencies, there is still a problem when a transient comprises two or more close characteristic frequencies. This causes the spectrum to comprise two or more overlapping peaks. If the separation (or difference) between two characteristic frequencies of the transient is less than a threshold value, then the two peaks will not be resolved. This error leads to errors in the converted m/z ratios (and therefore ionic species being identified incorrectly) along with errors in the converted relative abundances. Although it depends on the local spectral density, the practical threshold value for reliable resolution is twice the separation of the Fourier grid corresponding to the original transient i.e. the transient without zero padding.

FIG. 1A of the accompanying drawings shows an example of such a problem. The figure shows a first signal 150 of a transient, a second signal 160 of the transient and a spectrum 170 of the transient. The first signal 150 has a characteristic frequency $f_1$. The second signal 160 has a characteristic frequency $f_2$. The difference between $f_1$ and $f_2$ is equal to the separation of the Fourier grid. The spectrum 170 has two central peaks. The leftmost peak of the spectrum 170 corresponds to the second signal 160. The rightmost peak of the spectrum 170 corresponds to the first signal 150. There is also an error 174 between the centroid of the peak and the associated characteristic frequency. There is an error 172 between the height (or intensity) of the peak and the height (or intensity) of the corresponding signal 150, 160. The errors become more pronounced as the spectral density (i.e. number of harmonic components for a given region of a spectrum) increases, and their separation diminishes.

FIG. 1B of the accompanying drawings illustrates the problem. The figure shows a first signal 150 of a transient, a second signal 160 of the transient and a spectrum 170 that will be reproduced from the transient. In this case, the difference between $f_1$ and $f_2$ is equal to half the separation of the Fourier grid. The spectrum 170 has a single peak i.e. the characteristic frequencies corresponding to the two signals 150, 160 are not resolved. The centroid of the single peak of the spectrum is in error compared to either of the two characteristic frequencies. Additionally, the height of the single peak is neither equivalent to the sum of the heights of the two signals 150, 160 nor either one of the heights of the two signals 150, 160. Due to these errors, neither of the ionic species corresponding to the signals 150, 160 will be correctly identified. Also the relative abundance reported from the peak will be incorrect. This may lead to errors in abundance ratios calculated using other peaks in the signal 170 which may, themselves be accurate.

Interpolation of the spectrum, for example by zero-padding as described above, neither reduces these errors nor improves the resolution. In fact, the zero-padded and optionally apodized FT amplitudes are linear combinations of the FT amplitudes and carry no extra useful information. This can be seen by the fact that the complex amplitudes $s_n$ of the Fourier transform of a signal S(t) without zero-padding obey the following relation:

$$s_n = \frac{1}{T}\int_0^T S(t)\exp\left(-2\pi i\frac{n}{T}t\right)dt$$

whilst the complex amplitudes $b_m$ of the Fourier transform of the signal S(t) with P times zero-padding obey the following relation:

$$b_m = \frac{1}{T}\int_0^T S(t)\exp\left(-2\pi i\frac{m}{PT}t\right)dt$$

Therefore, the complex amplitudes $b_m$ (i.e. with the zero-padding) are required to be linear combinations of the complex amplitudes $s_n$ (i.e. without the zero-padding). In particular, the complex amplitudes $b_m$ must obey:

$$b_m = \frac{1}{T}\sum_n \int_0^T \exp\left(2\pi i\frac{n}{T}t\right)\exp\left(-2\pi i\frac{m}{PT}t\right)dt\, s_n$$

which reduces to:

$$b_m = P\frac{\exp\left(-2\pi i\frac{m}{P}\right)-1}{2\pi i}\sum_n \frac{s_n}{nP-m}$$

SUMMARY OF THE INVENTION

Embodiments of the invention seek to address the above described problems and other of the related prior-art.

A first aspect of the invention provides a method of producing a mass spectrum from a time-varying transient signal detected in a mass spectrometer. The method comprises the following steps.

A Fourier transform of the transient signal is performed to produce a first set of complex amplitudes, where each of the complex amplitudes corresponds to a respective frequency of a first set of frequencies. The first set of frequencies may be equally spaced in frequency. A second set of complex amplitudes is generated, where each of these complex amplitudes corresponds to a respective frequency of a second set of frequencies. The second set of frequencies may be equally spaced in frequency. The second set of frequencies may have a spacing (or a minimum spacing) that is less than that of the first set of frequencies. The second set of frequencies may have a spacing (or a minimum spacing) that is less than the inverse of the duration of the transient signal. The second set of complex amplitudes may cover (or span or correspond to) the same frequency range as the first set of complex amplitudes, and so the second set may contain more complex amplitudes than the first set. Hence, the second set of complex amplitudes may provide greater resolution.

The second set of complex amplitudes is optimized to produce an improved second set of complex amplitudes. At least some of the complex amplitudes from the improved second set are used to generate and display a mass spectrum. The improved second set of complex amplitudes provides a better quality mass spectrum.

Optimizing the second set of complex amplitudes comprises varying at least one of the complex amplitudes of the second set based on (or in dependence on) an objective function. For example, the at least one complex amplitudes may be varied with the aim of obtaining a substantially extremum value of the objective function. Optionally, all of the complex amplitudes from the second set may be varied as part of the optimizing step, or a subset may be optimized as part of the optimizing step.

The optimization may be performed subject to a constraint. That is, for at least some of the complex amplitudes of the second set, a constraint is placed on the phase of each of the at least some complex amplitudes relative to one or more expected phases. The expected phases may be frequency-dependent. The objective function depends on one or more complex amplitudes of the first set of complex amplitudes and one or more complex amplitudes of the second set of complex amplitudes. The objective function may, for each frequency of the first set of frequencies, relate one or more complex amplitudes of the second set to the respective complex amplitude from the first set (such as by having the objective function a function of the one or more complex amplitudes of the second set and the respective complex amplitude from the first set). The constraint may be applied to all the complex amplitudes of the second set that are being varied as part of the optimizing step, or to a subset of those complex amplitudes.

It can be seen that by generating and optimizing a second set of complex amplitudes, the transient may be thought of as being decomposed onto a finer frequency grid. As the second set of complex amplitudes is not bound to the first set of complex amplitudes as a linear combination of these amplitudes, unlike in the interpolation method described previously, the resolution increases as the grid spacing of the second set of frequencies decreases. This leads to a much increased accuracy of the resulting mass spectrum. In other words the method may be thought of as operating with two sets of frequencies. The first set of frequencies may comprise frequencies with a minimum separation of 1/T, where T is the time duration of the transient signal. The second set of frequencies may comprise the frequencies with a minimum separation less than 1/T. The second set of frequencies may contain the first set as a subset. Since the minimum spacing of the second set is less than that of the first set of frequencies, the second set of complex amplitudes may provide greater resolution.

It will be appreciated that by "complex" is to be understood as relating to a number that can be expressed with a real and imaginary part. The imaginary part may be zero i.e. complex as used herein covers real numbers.

One advantage of the invention is the integrability of the mass spectrum produced. In other words, the intensity of all peaks, both resolved and unresolved, is conserved. As such the suppression effects of the standard Fourier transform approach, caused by the interference of adjacent peaks is avoided. Thus the invention may be of particular benefit where highly accurate intensity information is desired. Moreover, computations can be conducted on shorter transients increasing the speed and throughput of the instruments. Examples include many mass spectrometry (MS) techniques such as any of: tandem MS, hybrid MS, Liquid Chromatography MS, Ion Mobility Spectroscopy MS, Gas Chromatography MS, Capillary Electrophoresis MS, and so forth.

In some embodiments, the step of performing a Fourier transform includes windowing the Fourier-transformed transient signal in the frequency domain, wherein the first set of complex amplitudes correspond to the windowed Fourier-transformed transient signal. Said windowing may comprise applying a windowing function to the first set of complex amplitudes. Typically, applying a windowing function includes scaling each complex amplitude of the first set of complex amplitudes by the value of the windowing function at the respective frequency. Additionally, or alternatively, said windowing may comprise discarding the complex amplitudes whose respective frequency is outside of one or more pre-defined ranges. For example, complex amplitudes of the first set of complex amplitudes whose respective frequency is above the Nyquist frequency of the transient signal may be discarded, and/or set to zero.

Advantageously, this may allow an increase in processing speed and reduction of computational burden, as the subsequent processing may be limited to regions of interest only. For a sparse enough spectrum or sparse enough segments of interest, calculations can be carried only within windows of the spectra encapsulating these regions. Such an approach may be particularly beneficial when extracting a Total Ion Chromatogram (TIC), which involves monitoring the entire ion population within a mass spectrometer across a chromatographic run. Here computational efficiency may be increased by using windowing to limit the above calculations to the range of frequencies corresponding to the feasible mass range or, in some cases, regions (e.g. where the feasible mass range is not substantially contiguous). In a similar way, by employing windowing, it may be particularly beneficial when extracting a Selected Ion Chromatogram (XIC or EIC), also known as Reconstructed-Ion Chromatogram (RIC). Here the ion population of one or more ionic species of interest within a mass spectrometer is monitored across a chromatographic run. As a particular case of such XIC, Base Peak Chromatogram monitors the most abundant species in each spectrum. Here, the improvements offered by this embodiment allow for the windowing to be applied dynamically in a data dependent way.

Other mass spectrometry scanning modes which may benefit from this embodiment of the invention for similar reasons include:

- Selected Ion Monitoring (SIM), where only a subset of ionic species is selectively introduced into a mass spectrometer and their total abundance is reported.
- Tandem mass spectrometry (or $MS^2$), such as Selected Reaction Monitoring (SRM), where intensity of product ions for given precursor ion(s) are being monitored after the fragmentation event.
- Multi-stage mass spectrometry (or $MS^n$, n=1, 2 . . . ) where intensity of n-th generation mass peak is monitored after fragmentation event(s).
- Consecutive Reaction Monitoring (CRM) and other further stages of Tandem mass spectrometry, including Multiple Reaction Monitoring (MRM).
- Parallel Reaction Monitoring (PRM), when for a given precursor ion multiple product ions resulting from different fragmentation pathways are monitored concurrently.

In this way there is also provided the use of the method as part of any one of, or any combination of: a Selected Ion Chromatogram monitoring; a Reconstructed-Ion Chromatogram monitoring; a Selected Ion Monitoring experiment; a Base Peak Chromatogram monitoring; a tandem mass spectrometry experiment (such as a Selected Reaction Monitoring experiment); a Consecutive Reaction Monitoring experiment; a Multiple Reaction Monitoring experiment; and a Parallel Reaction Monitoring experiment.

For a number of applications, both high mass resolution and abundance fidelity are very important. An example of that would be experiments requiring isotope fine structure analysis. Due to the phenomenon known as mass defect (the difference between the mass of an atomic nuclei and the sum of the masses of its constituents caused by the binding energy), isotopic mass spectra tend to be very dense with irregular spacing. Resolving fine isotopic structure, even for relatively simple chemical compounds, requires extreme mass resolving power, typically in excess of $10^5$-$10^6$. As chemical complexity of interrogated compounds increases, errors in isotopic abundances as calculated in the prior-art become inevitable because of interference. Therefore, it may be advantageous to use the above embodiments of the invention to improve the fidelity of isotope ratios.

In some embodiments, the constraint comprises requiring the phase of a complex amplitude to be equal to the expected phase or to be within a range around the expected phase. The expected phase may be derived from any of: the arrangement of the mass spectrometer; an ion injection process into the mass spectrometer; an ion excitation process in the mass spectrometer; a signal detection method; a measured phase of one or more harmonic spectral components in the transient; or a measured phase of one or more harmonic spectral components in any transient obtained in this mass spectrometer before or after obtaining the processed transient. This advantageously allows the optimization to be guided by some known properties of the mass spectrometer and/or data other that what is already present in the transient. This leads to an increased accuracy of the resulting mass spectrum.

In some embodiments the range is based at least in part on the jitter of the mass spectrometer. Thus, the method can take into account this possible source of error in the mass spectrometer.

In some embodiments, for each complex amplitude of the improved second set of complex amplitudes, the objective function comprises the product of that complex amplitude and the overlap of a respective Fourier basis function corresponding to a complex amplitude of the first set of complex amplitudes and a respective second basis function corresponding to that complex amplitude. Such an overlap may be seen as representing the basis function corresponding to a complex amplitude from the second set in terms of the basis function of a complex amplitude from the first set. As such, this allows the objective function to directly compare complex amplitudes from the second set with complex amplitudes from the first set. Put another way the objective function may be seen as comprising an object which is the expansion of one or more of the complex amplitudes of the second set in terms of a coarser frequency grid corresponding to the first set of complex amplitudes.

In some embodiments the respective second basis function comprises a Fourier basis function.

In some embodiments, account may be taken of harmonics that contribute to the complex amplitudes. For example, at least one complex amplitude of the second set of complex amplitudes may comprise a respective auxiliary complex amplitude corresponding to the respective frequency; and a scaled further complex amplitude. Here the scaled complex amplitude corresponds to a further frequency of the second set of frequencies. In this case the constraint on the phase of the particular complex amplitude comprises a constraint on the phase of the respective auxiliary complex amplitude relative to a frequency-dependent expected phase. The respective frequency may correspond to a harmonic of the further frequency. This allows the method to take into account the fact that the shape of each periodic signal in the transient may not be typically exactly the same as the shape of the basis functions that correspond to the set of second complex amplitudes. In particular where a periodic signal gives rise to complex amplitudes at more than one frequency (or harmonic) the optimization can use this data (via the scaling) to improve the accuracy of the improved set of complex amplitudes.

In some embodiments the further complex amplitude is a complex amplitude from the second set of complex amplitudes or an auxiliary complex amplitude of a complex amplitude from the second set of complex amplitudes. Use of an auxiliary complex amplitude in this way can advantageously allow for the fact that a harmonic frequency of a particular frequency may itself have its own harmonic frequencies. Hence, the complex amplitude corresponding to a harmonic frequency may also be decomposed into an auxiliary complex amplitude and a further complex amplitude.

In some embodiments the scaling is based at least in part on any of: (a) the arrangement of one or more electrodes in the mass spectrometer; (b) arrangement of the mass spectrometer; (c) amplitude of the ion oscillation; or (d) shape of the ion orbit.

In some embodiments the optimization comprises substantially maximizing a dual function of the objective function. As is well known in the art, a dual function may be thought of as a function which may be substantially maximized (or substantially minimized) as a proxy for substantially minimizing (or substantially maximizing), an objective function subject to constraints. Typically the dual function may be substantially maximized (or substantially minimized) across a different set of arguments than the objective function.

In some embodiments the optimization is based on any of: an iterative procedure, or Proximal Minimization.

In some embodiments the optimization is based on the Alternate Direction Method of Multipliers. This is a particularly efficient way of optimizing the complex amplitudes can comprise only component-wise operations, which may be efficiently implemented on parallel computing hardware, and Fast Fourier Transform (FFT) operations which can also be efficiently implemented on parallel computing hardware. This allows the method to scale efficiently in terms of computing power required for increasing numbers of complex amplitudes which may correspond to improved resolution.

According to another aspect of the invention there is provided an apparatus arranged to carry out a method according to the first aspect (or embodiments thereof). According to another aspect of the invention there is provided a computer program which, when executed by one or more processors, causes the one or more processors to carry out a method according to the first aspect (or embodiments thereof). The computer program may be stored on a computer-readable medium.

BRIEF DESCRIPTION OF THE DRAWINGS

The present invention may be put into practice in various ways, a number of which will now be described by way of example only and with reference to the accompanying drawings in which.

DETAILED DESCRIPTION OF PREFERRED EMBODIMENTS

Figure 1A:
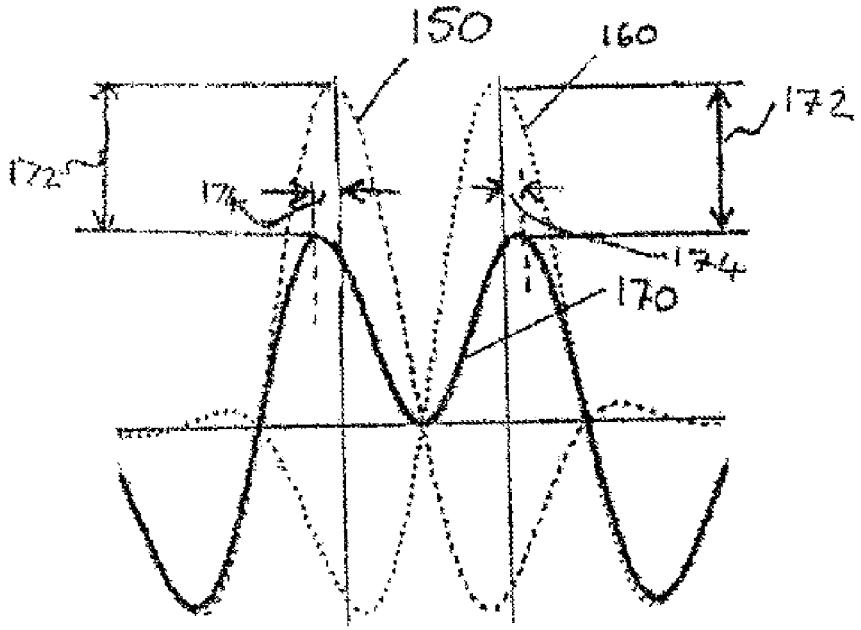
FIG. 1A shows an example of a known resolution problem.
Figure 1B:
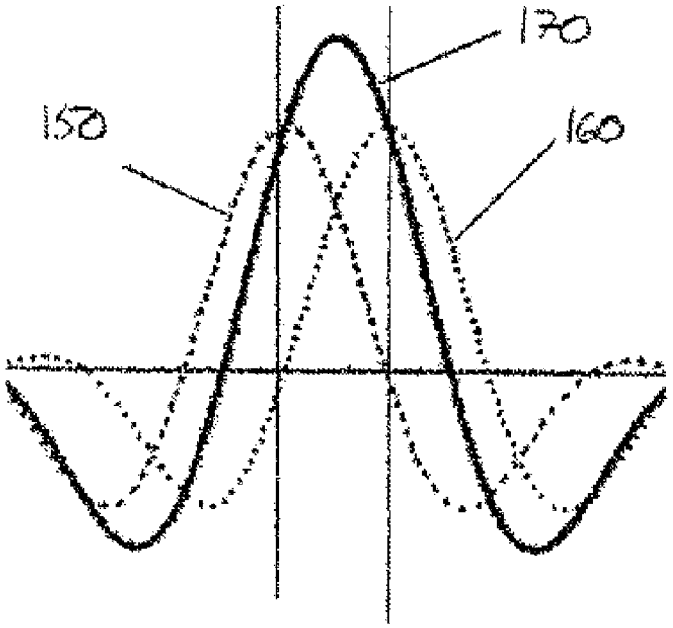
FIG. 1B shows another example of a known resolution problem.
Figure 2:
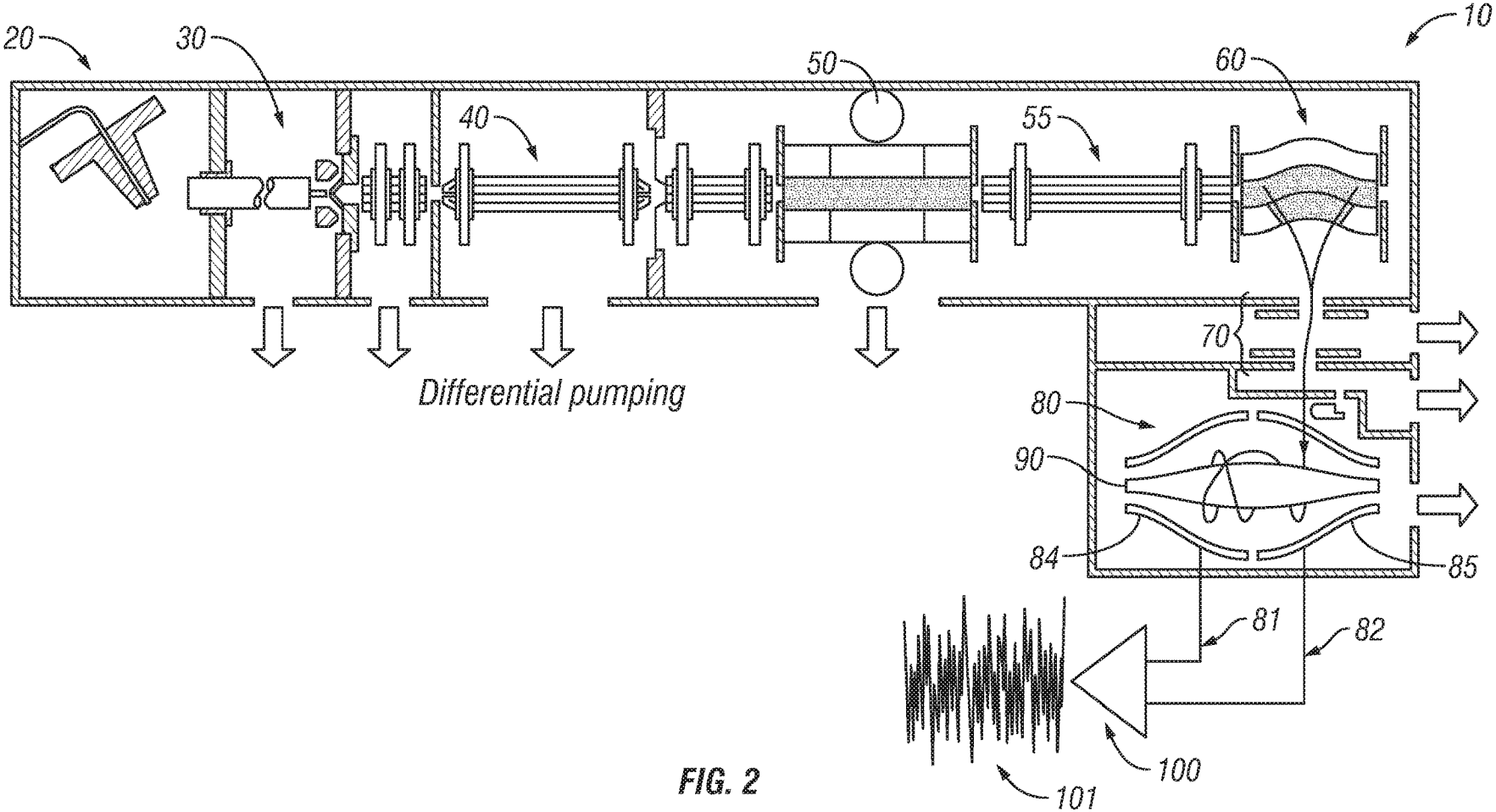
FIG. 2 shows a schematic arrangement of a typical mass spectrometer.

FIG. 2 shows a schematic arrangement of a typical ORBITRAP mass spectrometer. The arrangement of FIG. 2 is described in detailed in commonly assigned WO-A-02/078046 the entire contents of which are incorporated herein by reference, and will not be described in detail here. A brief description of FIG. 2 is, however, included in order to understand the use and purpose of the mass spectrometer better.

As seen in FIG. 2, the mass spectrometer 10 includes a continuous or pulsed ion source 20 which generates gas-phase ions. These pass through an ion source block 30 into an RF transmission device 40, which cools ions by collisions with gas. The cooled ions then enter a mass filter 50, which extracts only those ions within a window of m/z ratios of interest. Ions within the mass range of interest then proceed into a linear trap 60 (typically, a C-trap), which stores ions in a trapping volume through application of an RF potential to a set of rods (typically quadrupole, hexapole or octapole).

As explained in more detail in WO-A-02/078046, ions are held in the linear trap 60 in a potential well, the bottom of which may be located adjacent to an exit electrode thereof. Ions are ejected out of the linear trap 60 into a lens arrangement 70 by applying a DC pulse to the exit electrode of the linear trap 60. Ions pass through the lens arrangement 70 along a line that is curved to avoid gas carry-over, and into an electrostatic trap 80 (also known as a mass analyzer). In FIG. 2, the electrostatic trap 80 is the so-called "ORBITRAP" type electrostatic trap, which contains a split outer electrode 84, 85 and an inner electrode 90.

In operation, a voltage pulse is applied to the exit electrode of the linear trap 60 so as to release trapped ions. The ions arrive at the entrance to the electrostatic trap 80 as a sequence of short, energetic packets, each packet comprising ions of a similar m/z ratio.

The ions enter the electrostatic trap 80 as coherent bunches and are squeezed towards the central electrode 90. The ions are then trapped in an electrostatic field such that they oscillate along the central electrode with the frequencies depending on their m/z ratios. Image currents are detected by the first outer electrode 84 and the second outer electrode 85, providing first harmonic transient signal 81 and second harmonic transient signal 82 respectively. These two signals are then processed by a differential amplifier 100 and provide a transient image current signal 101 (herein referred to as the transient).

Therefore, the transient 101 comprises a superposition of one or more periodic signals (or harmonic spectral components). Each periodic signal corresponds to the oscillation of a respective coherent packet of ions within the mass analyzer with a respective characteristic frequency determined by the m/z ratio of the ions.

It will be appreciated that the mass spectrometer 10 outlined above serves merely as an exemplar as to how the transient 101 may be generated. The embodiments of the invention presented below may use any suitable transient 101 produced by any mass spectrometer 10. In particular whilst the mass spectrometer described above is an ORBITRAP mass spectrometer, a particular example of a mass spectrometer that uses an orbital trapping electrostatic trap, the embodiments of the invention described below are not limited to such a mass spectrometer.

Figure 3:
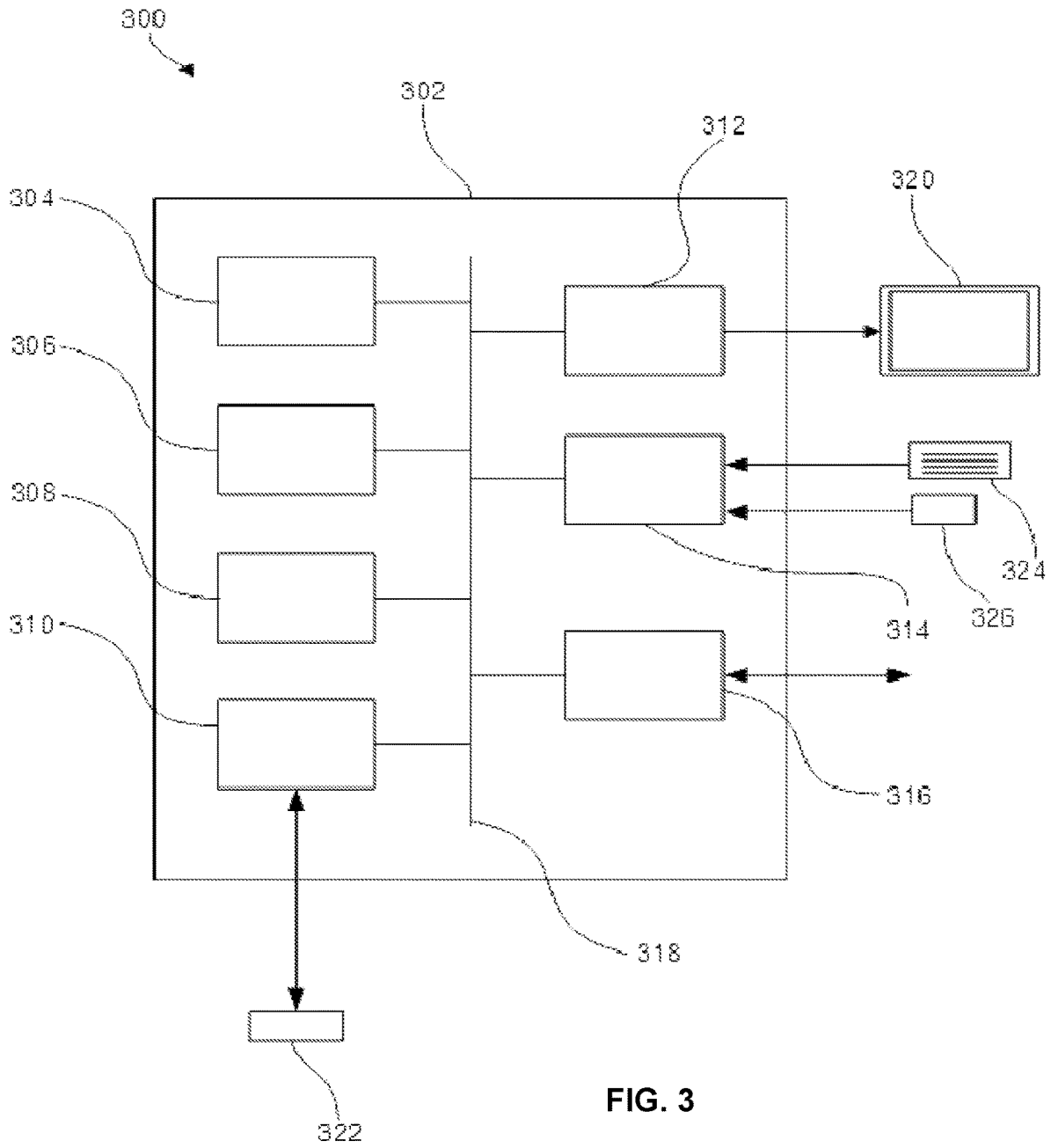
FIG. 3 schematically illustrates an example of a computer system.

FIG. 3 schematically illustrates an example of a computer system 300. The system 300 comprises a computer 302. The computer 302 comprises: a storage medium 304, a memory 306, a processor 308, an interface 310, a user output interface 312, a user input interface 314 and a network interface 316, which are all linked together over one or more communication buses 318.

The storage medium 304 may be any form of non-volatile data storage device such as one or more of a hard disk drive, a magnetic disc, an optical disc, a ROM, etc. The storage medium 304 may store an operating system for the processor 308 to execute in order for the computer 302 to function. The storage medium 304 may also store one or more computer programs (or software or instructions or code).

The memory 306 may be any random access memory (storage unit or volatile storage medium) suitable for storing data and/or computer programs (or software or instructions or code).

The processor 308 may be any data processing unit suitable for executing one or more computer programs (such as those stored on the storage medium 304 and/or in the memory 306), some of which may be computer programs according to embodiments of the invention or computer programs that, when executed by the processor 308, cause the processor 308 to carry out a method according to an embodiment of the invention and configure the system 300 to be a system according to an embodiment of the invention. The processor 308 may comprise a single data processing unit or multiple data processing units operating in parallel, separately or in cooperation with each other. The processor 308, in carrying out data processing operations for embodiments of the invention, may store data to and/or read data from the storage medium 304 and/or the memory 306.

The interface 310 may be any unit for providing an interface to a device 322 external to, or removable from, the computer 302. The device 322 may be a data storage device, for example, one or more of an optical disc, a magnetic disc, a solid-state-storage device, etc. The device 322 may have processing capabilities—for example, the device may be a smart card. The interface 310 may therefore access data from, or provide data to, or interface with, the device 322 in accordance with one or more commands that it receives from the processor 308.

The user input interface 314 is arranged to receive input from a user, or operator, of the system 300. The user may provide this input via one or more input devices of the system 300, such as a mouse (or other pointing device) 326 and/or a keyboard 324, that are connected to, or in communication with, the user input interface 314. However, it will be appreciated that the user may provide input to the computer 302 via one or more additional or alternative input devices (such as a touch screen). The computer 302 may store the input received from the input devices via the user input interface 314 in the memory 306 for the processor 308 to subsequently access and process, or may pass it straight to the processor 308, so that the processor 308 can respond to the user input accordingly.

The user output interface 312 is arranged to provide a graphical/visual output to a user, or operator, of the system 300. As such, the processor 308 may be arranged to instruct the user output interface 312 to form an image/video signal representing a desired graphical output, and to provide this signal to a monitor (or screen or display unit) 320 of the system 300 that is connected to the user output interface 312.

Finally, the network interface 316 provides functionality for the computer 302 to download data from and/or upload data to one or more data communication networks.

It will be appreciated that the architecture of the system 300 illustrated in FIG. 3 and described above is merely exemplary and that other computer systems 300 with different architectures (for example with fewer components than shown in FIG. 3 or with additional and/or alternative components than shown in FIG. 3) may be used in embodiments of the invention. As examples, the computer system 300 could comprise one or more of: a personal computer; a server computer; a laptop; etc.

Figure 4A:
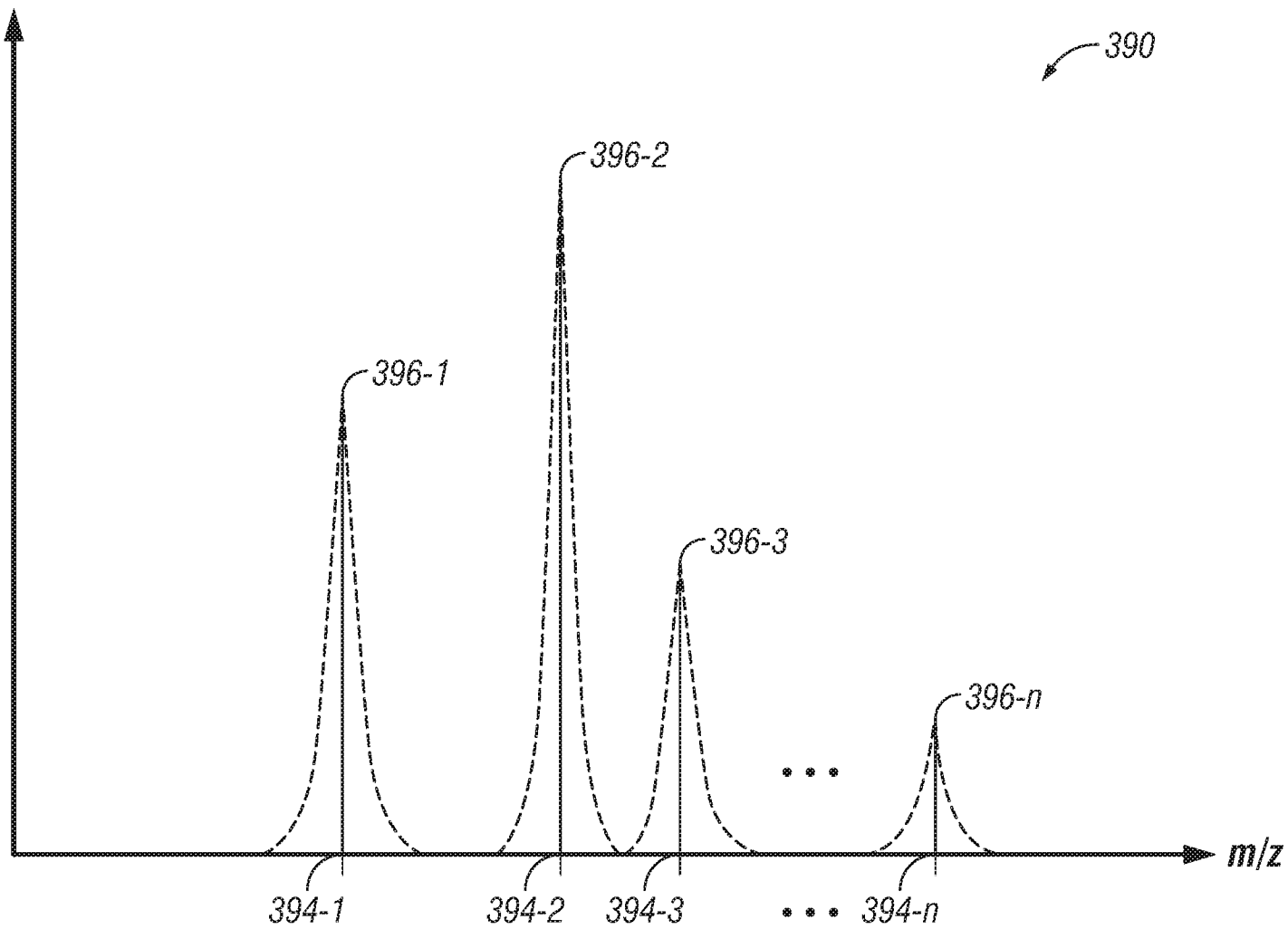
FIG. 4A shows an example graphical representation of a mass spectrum.

FIG. 4A shows an example graphical representation of a mass spectrum 390.

The mass spectrum 390 comprises one or more m/z values (or mass to charge ratios) 394-*n*. Each m/z value corresponds to a respective ionic species and is equal to the molecular mass of the respective ionic species divided by the absolute elemental charge of the respective ionic species. The mass spectrum 390 comprises one or more intensity values 396-*n* with each intensity value 396-*n* appearing for a respective m/z value 394-*n*. Each intensity value 396-*n* correlates to the relative abundance of the ionic species corresponding to the respective m/z value 394-*n*. Each intensity value 396-*n* may be proportional to the relative abundance of the ionic species corresponding to the respective m/z value.

An experimental mass spectrum such as the mass spectrum 390 may be plotted in the form of a continuum plot, indicated by the dashed line, and a centroid plot, indicated by the vertical solid lines. The widths of peaks indicated by the dashed line represent the limit of the mass resolving power, which is the ability to distinguish two different ionic species with close m/z ratios.

However it will be appreciated that the mass spectrum 390 does not need to be plotted in the form of a graph. Indeed, the mass spectrum 390 may be represented in any suitable form. For example, the mass spectrum 390 may be represented a list comprising the one or more intensity values 396-*n* and the one or more m/z values 394-*n*.

Figure 4B:
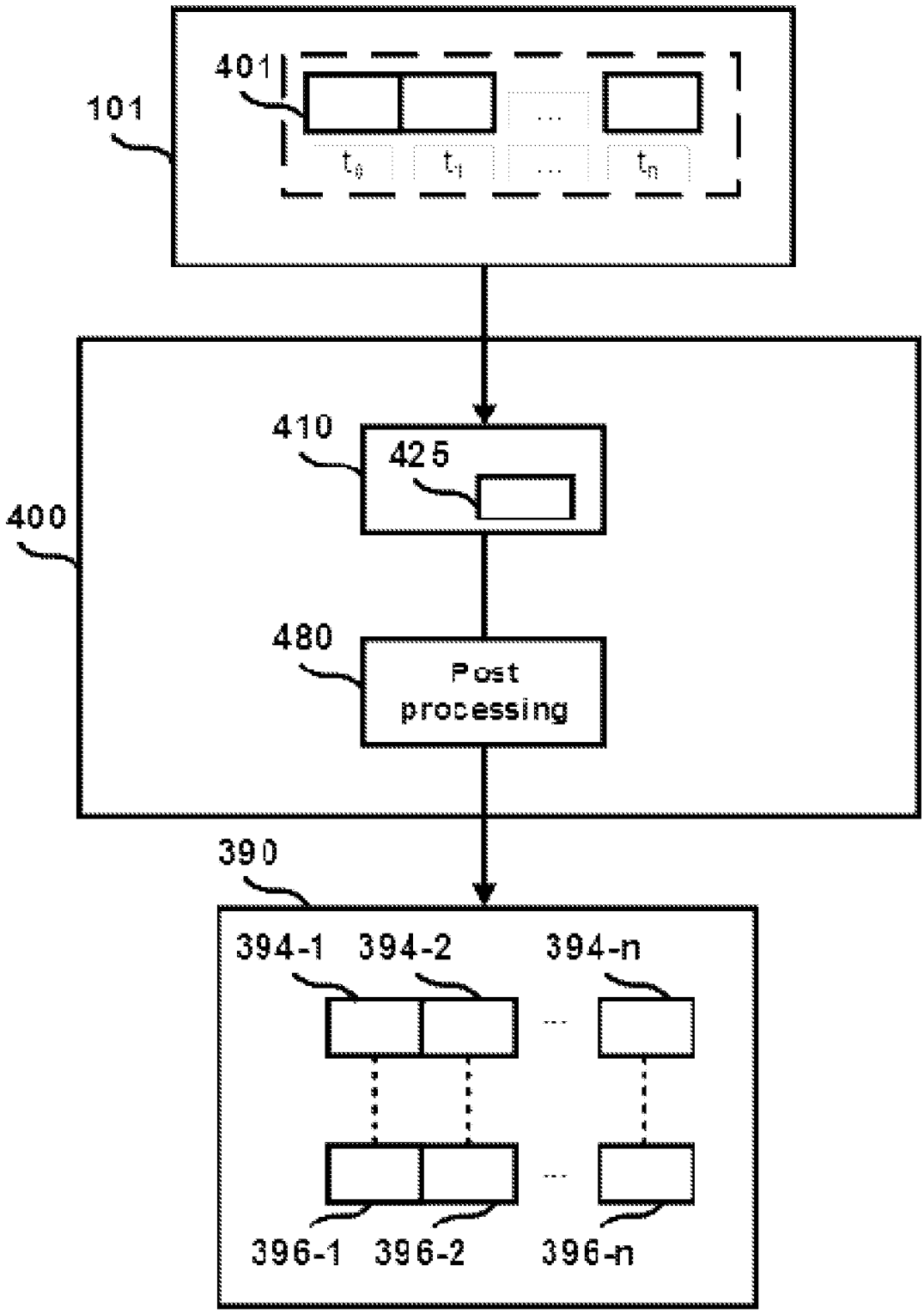
FIG. 4B schematically illustrates an example transient processing system.

FIG. 4B schematically illustrates an example transient processing system 400. The figure shows the system 400 receiving a transient 101 as input and generating a mass spectrum 390 as an output. The transient 101 is as described previously. The mass spectrum 390 may be as described above, and shown in FIG. 4A. In FIG. 4B, the mass spectrum is represented as comprising one or more m/z values 394-*n* and one or more intensity values 396-*n* with each intensity value 396-*n* appearing for a respective m/z value 394-*n*.

The transient processing system 400 comprises a Fourier transform module 410 and a post processing module 480. The transient processing system 400 may be implemented on a computer system 300 as described with reference to FIG. 3. The transient processing system 400 may be communicatively coupled to a mass spectrometer 10. For example the transient processing system 400 may be communicatively coupled to the mass spectrometer via the network interface 316. The transient processing system 300 is arranged to receive the transient 101. For example the transient processing system 400 may be arranged to receive the transient 101 via any of: the network interface 316; the input interface 310; the user input interface 314; etc. The transient processing system 400 may be arranged to have stored thereon the transient 101. For example the transient 101 may be stored on the storage device 304.

The transient 101 can be represented by a time varying function S(t). The transient is only measured (or captured or recorded) over a finite time T, termed the "duration" of the transient. For the purposes of discussion the time varying function S(t) representing the transient is shown as a continuous function of time, t. However it will be appreciated that the transient 101 may also, or alternatively, be sampled. In particular, the transient may be represented by a set of values $S_{t_k}$ 401, where $S_{t_k}=S(t_k)$, for a set of times $t_0$, $t_1, \ldots, t_N$. The transient may be sampled at a regular time interval. For example, $t_k=k\Delta t$, where k is an integer number and $\Delta t$ is a regular time interval.

The Fourier transform module 410 is arranged to calculate at least part 425 of a discrete Fourier transform of the transient 101. The discrete Fourier transform is described shortly below.

The post processing module 480 is arranged to calculate a mass spectrum 390 based on the at least part 425 of a discrete Fourier transform.

Figure 4C:
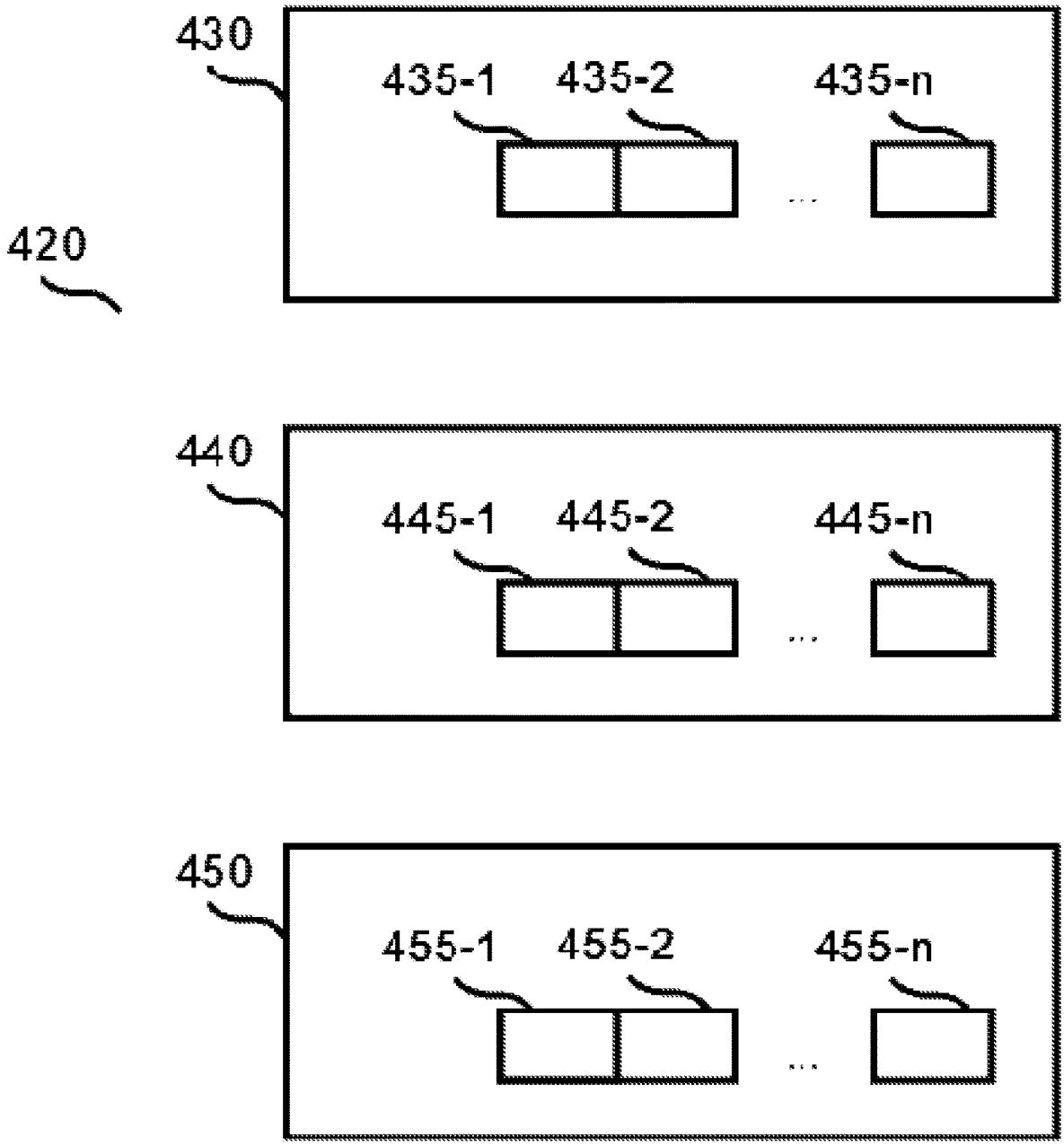
FIG. 4C schematically illustrates a Fourier transform of a transient.

FIG. 4C shows a schematic diagram of a discrete Fourier transform 420 of a transient 101. The transient 101 has been described previously. The discrete Fourier transform 420 comprises a set 430 of frequencies 435-*n*, a set 440 of basis functions 445-*n* and a set 450 of complex amplitudes 455-*n*.

The set 430 of frequencies 435-*n* comprises a plurality of frequencies $f_0, f_1, \ldots$. For the purposes of discussion an arbitrary frequency 435-*n* from the plurality of frequencies will be referred to herein as $f_n$. Each frequency 435-*n* of the set 430 of frequencies 435-*n* corresponds to a respective frequency bin of the discrete Fourier transform. The separation (or arithmetic difference between) between adjacent frequencies 435-*n* in the set 430 of frequencies 435-*n* (referred to herein as the "spacing" of a set of frequencies) is determined by the duration of the transient 101. In particular, the arithmetic difference between two adjacent frequencies 435-*n* in the set 430 of frequencies 435-*n* is proportional to the inverse of the duration of the transient 101. For example, the separation may be given by the mathematical relation $f_n-f_{n-1}=1/T$. In particular, each frequency 435-*n* in the set 430 of frequencies 435-*n* may follow the relation $f_n=n/T$, where n is an integer number.

It will be appreciated that the set 430 of frequencies 435-*n* may not be equally spaced. In other words the separation between adjacent frequencies 435-*n* may not be constant. In this case the separation described above may refer to the "minimum separation" i.e. the arithmetic difference between the two closest frequencies 435-*n* in the set 430 of frequencies 435-*n*.

The set 440 of basis functions 445-*n* comprise a plurality of basis functions 445-*n*, $h_0, h_1, \ldots$. For the purposes of discussion an arbitrary basis function 445-*n* from the plurality of basis functions 445-*n* will be referred to herein as $h_n$. Each basis function 445-*n* of the set of basis functions 450 corresponds to a respective frequency 435-*n* of the set 430 of frequencies 435-*n*. A basis function 445-*n* may be time-dependent. Each basis function 445-*n* of the set 440 of basis functions 445-*n* may comprise a respective Fourier basis function. The respective Fourier basis function of the basis function 445-*n* may correspond to the respective frequency corresponding to the basis function 445-*n*. For example, for a basis function 445-*n* $h_n(t)$, the basis 445-*n* may follow the relation:

$$h_n(t)=e^{2\pi i f_n t}$$

The set 450 of complex amplitudes 455-*n* comprises a plurality of complex amplitudes 455-*n*, $s_0$, $s_1$, . . . . For the purposes of discussion an arbitrary complex amplitude 455-*n* from the plurality of complex amplitudes 455-*n* will be referred to herein as $s_n$. Each complex amplitude 455-*n* of the set 450 of complex amplitudes 455-*n* corresponds to a respective frequency 435-*n* of the set 430 of frequencies 435-*n*. Each complex amplitude 455-*n* of the set 450 of complex amplitudes 455-*n*-*n* corresponds to a respective basis function 445-*n* of the set 440 of basis functions 445-*n*. In particular, each complex amplitude 455-*n* of the set 450 of complex amplitudes 455-*n* may follow the relation:

$$s_n = \frac{1}{T}\int_o^T S(t)e^{-2\pi i f_n t}\,dt$$

If the transient 101 S(t) is sampled, as described previously, then the above integral may be replaced with the appropriate sum. For example, each complex amplitude 455-*n* of the set 450 of complex amplitudes 455-*n* may follow the relation:

$$s_n = \frac{1}{T}\sum_k s_{t_k} e^{-2\pi i f_n t_k}$$

Thus it can be seen that the discrete Fourier transform of a transient 101 is the representation of the transient 101 as a superposition of the basis functions 445-*n* of the set 440 of basis functions 445-*n*, where each basis function 445-*n* of the set 440 of basis functions 445-*n* is scaled by a respective complex amplitude 455-*n* of the set 450 of complex amplitudes 455-*n*.

Figure 5:
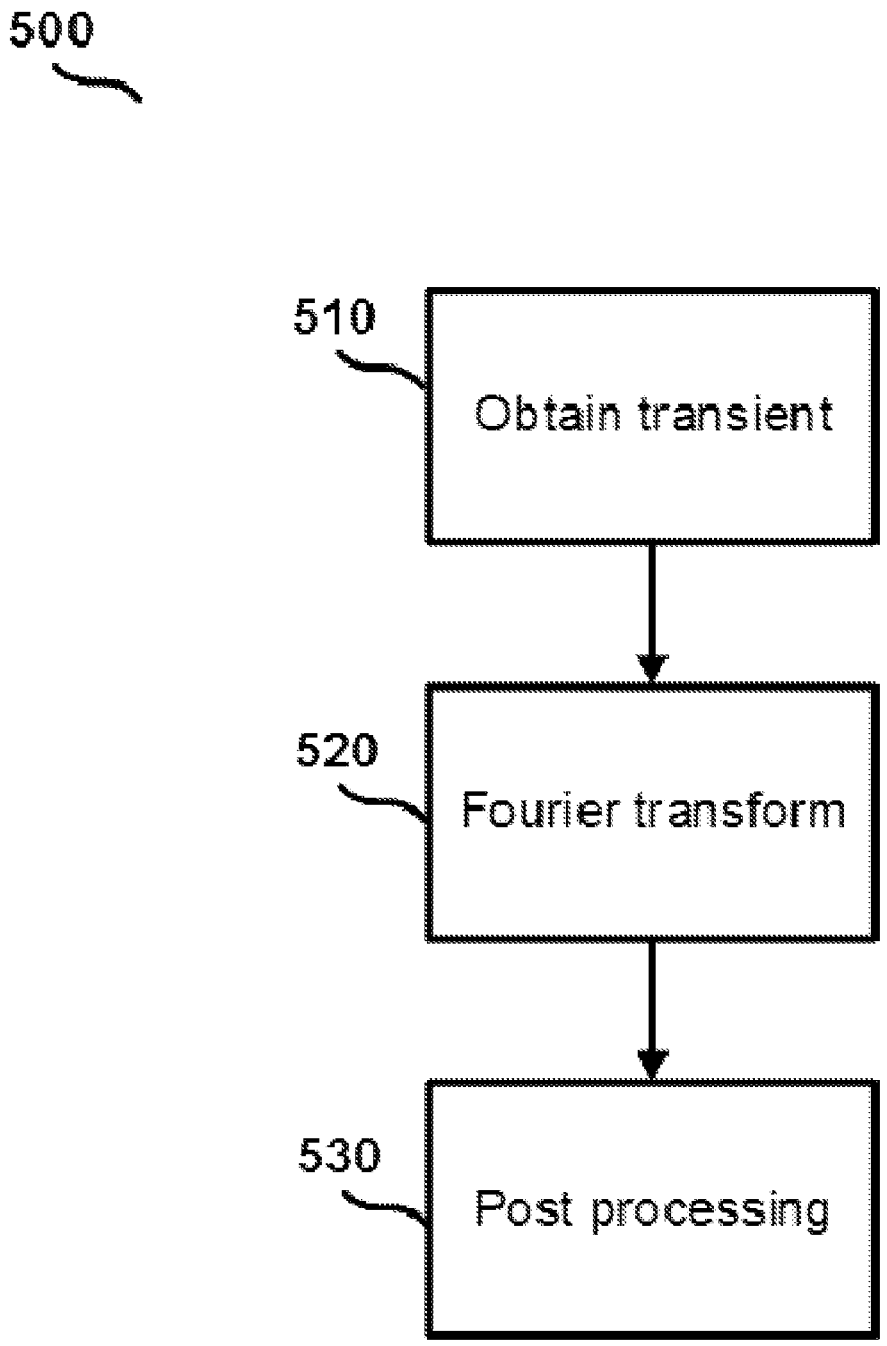
FIG. 5 is a flow diagram schematically illustrating an example method for processing a transient according to the transient processing system shown in FIG. 4B.

FIG. 5 is a flow diagram schematically illustrating an example method 500 for processing a transient according to the system 400 of FIG. 4B.

At a step 510 the transient 101 is obtained. The step 510 may comprise retrieving the transient 101 from the storage medium 304. Step 510 may comprise obtaining the transient 101 directly from the mass spectrometer 10. If the transient 101 is represented by a continuous time varying function S(t) the step 510 may comprise sampling the transient 101 as described previously in relation to FIG. 4B.

At a step 520 the Fourier transform module performs a Fourier transform of the transient 101. The step 520 comprises generating (or calculating) at least part of the set 450 of complex amplitudes 455-*n*. The at least part of the set 450 of complex amplitudes 455-*n* may comprise one or more complex amplitudes 455-*n* from the set 450 of complex amplitudes 455-*n* The step 520 may comprise using a fast Fourier transform (FFT) algorithm. The FFT algorithm may be any of: a Cooley-Tukey algorithm; a prime-factor algorithm; a Sande-Tukey algorithm; Rader's algorithm; etc. The step 520 comprises generating (or calculating or otherwise obtaining) at least part of the set 430 of frequencies 435-*n*.

At a step 530 the post processing module 480 generates a mass spectrum 390 based on the at least part of the set 450 of complex amplitudes 455-*n*. The step 530 may comprise generating the one or more intensity values 396-*n* from the at least part of the set 450 of complex amplitudes 455-*n*. For example, each of the one or more intensity values 396-*n* may be generated using the absolute value of one or more respective complex amplitudes 455-*n* from the at least part of the set 450 of complex amplitudes 455-*n*. The step 530 may comprise generating the one or more m/z values 394-*n* from one or more frequencies 435-*n* of the at least part of the set 430 of frequencies 435-*n*. For example, each of the one or more m/z values 394-*n* may be converted from one or more respective frequencies 435-*n* from the at least part of the set 430 of frequencies 435-*n*. The conversion may comprise using a calibration approach. Many such calibration approaches are known in the art (see for example, A. Makarov, "Theory and Practice of the ORBITRAP Mass Analyzer", in *Practical aspects of Trapped Ion Mass Spectrometry*, Vol. 4, Ed. R. E. March and J. F. J. Todd, CRC Press 2010, the entire contents of which are incorporated herein by reference) and are therefore not further described in detail herein.

In an example, the generating step 530 may comprise partitioning the complex amplitudes into one or more groups of complex amplitudes. The one or more frequencies 435-*n* corresponding to the one or more complex amplitudes 455-*n* in a group of complex amplitudes 455-*n* form a contiguous part of the set 430 of frequencies 435-*n*. Each complex amplitude 455-*n* in a group of complex amplitudes may exceed a predetermined threshold value. Additionally, or alternatively, the partitioning may be based at least in part on a user selection of one or more frequencies and/or one or more complex amplitudes. In this example, each of the one or more intensity values 396-*n* is generated based on the one or more complex amplitudes 455-*n* of the respective group of complex amplitudes. In particular, an intensity value 396-*n* may be a function of any of: the absolute values of the one or more complex amplitudes 455-*n* in the respective group of complex amplitudes, the real values of the one or more complex amplitudes 455-*n* in the respective group of complex amplitudes; the imaginary values of the one or more complex amplitudes 455-*n* in the respective group of complex amplitudes; etc. For example, an intensity value 396-*n* may be the sum of the absolute values of the one or more complex amplitudes 455-*n* in the respective group of complex amplitudes. Each of the one or more m/z values 394-*n* is converted from the one or more frequencies 435-*n* from the respective group of frequencies. In particular, each of the one or more m/z values 394-*n* may be converted from a weighted average of the one or more frequencies 435-*n* from the respective group of frequencies. Generating the weighted average of the one or more frequencies of a group of frequencies may comprise scaling each frequency 435-*n* of the one or more frequencies 435-*n* of a group of frequencies by the respective complex 455-*n* amplitude of the respective group of complex amplitudes. Such a weighted average may be referred to as a "centroid" of a peak represented by the group of complex amplitudes. The intensity of such a centroid could be considered to be the intensity value 396-*n* corresponding to the respective group of complex amplitudes which may be calculated as described above.

Figure 4D:
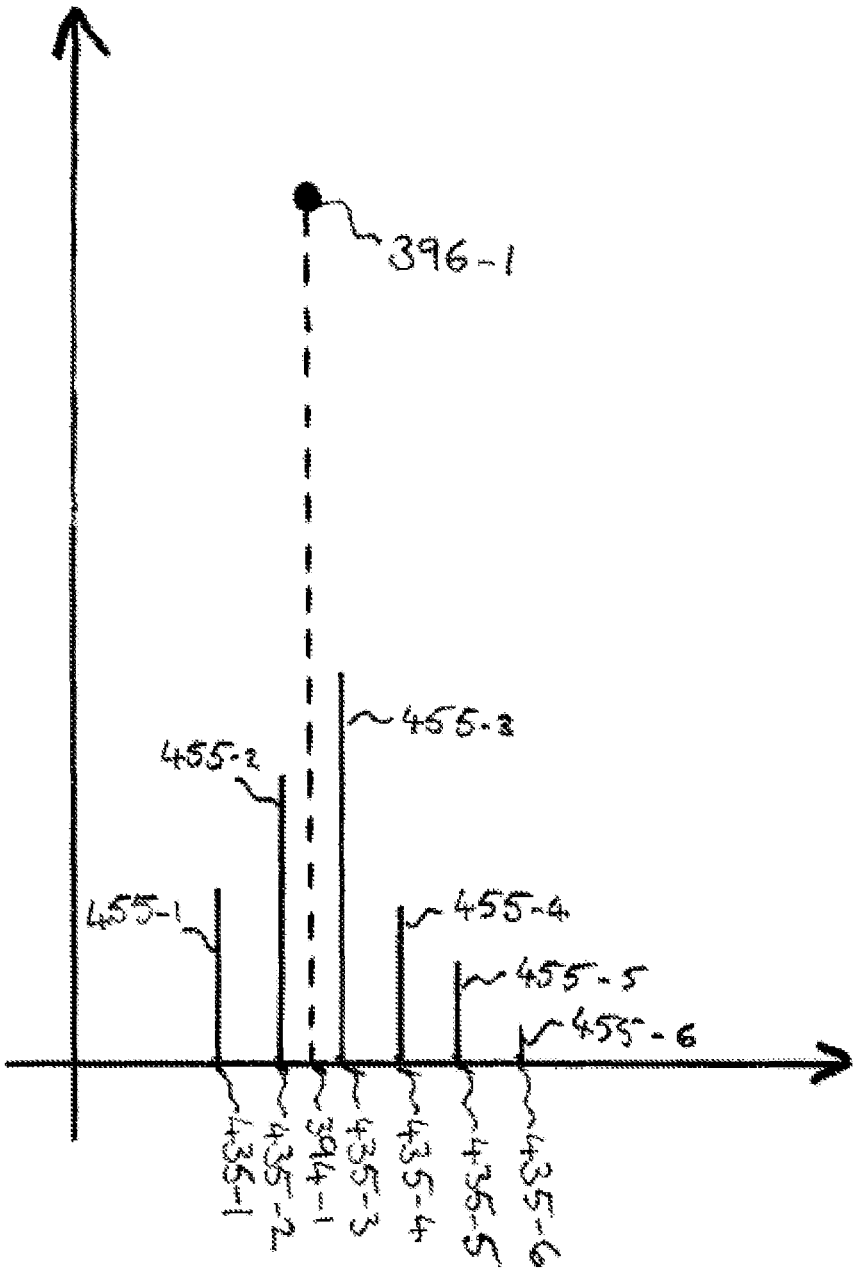
FIG. 4D schematically illustrates an example group of complex amplitudes.

FIG. 4D schematically illustrates an example group of complex amplitudes 455-1, 455-2, . . . , 455-6. Each complex amplitude 455-1, 455-2, . . . , 455-6 is shown as having a corresponding frequency 435-1, 435-2, . . . , 435-6. As shown this group of complex amplitudes 455-1, 455-2, . . . , 455-6 may be interpreted as a single peak. The centroid is shown as the dotted line and may be calculated as a weighted average of the frequencies 435-1, 435-2, . . . , 435-6 as described above. The centroid may be converted to an m/z value 394-1. The intensity value 396-1 corresponding to the centroid may be calculated as described above. In particular, the intensity value 396-1 may be calculated as the sum of the absolute values of the complex amplitudes 455-1, 455-2, . . . , 455-6. As FIG. 4D is a schematic diagram the centroid position and the intensity value 396-1 have not been drawn to scale.

Thus the system 400 and method 500 enable the relative abundance of ionic species present in the ion source 20 to be determined from the transient 101 produced by the mass spectrometer 10. In particular, by decomposing the transient 101 into a set 430 of frequencies 435-*n* and corresponding complex amplitudes 455-*n*, through a discrete Fourier transform 420, one or more frequencies 435-*n* of the set 430 of frequencies 435-*n* can be converted to m/z values 394-*n*, from which ionic species can be identified. This is because one or more frequencies 435-*n* (or one or more groups of frequencies) each correspond closely to the characteristic frequency of a respective periodic signal of the transient 101. However, as described previously, this is only the case when all possible pairs of characteristic frequencies have a greater separation than that of the set 430 of frequencies 435-*n*. When the separation of any pair of characteristic frequencies is equal to or less than the separation of the set 430 of frequencies 435-*n* then, due to the Fourier uncertainty principle, the pair of characteristic frequencies cannot be properly resolved in the discrete Fourier transform. Therefore, significant errors are introduced into the m/z values 394-*n* and/or relative abundances 396-*n* produced.

Figure 6A:
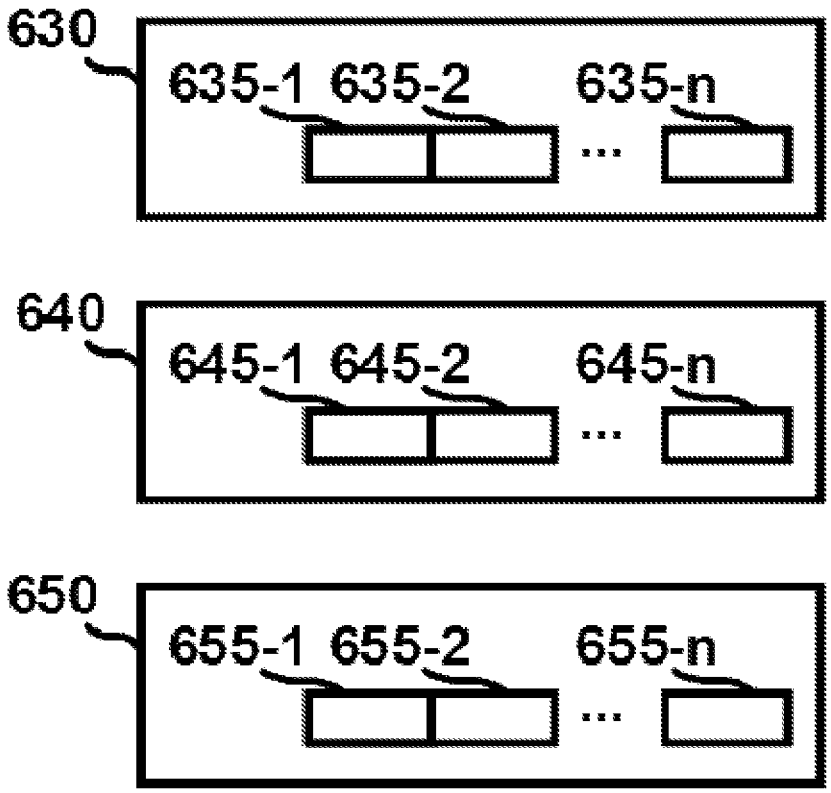
FIG. 6A schematically illustrates a set of complex amplitudes.

FIG. 6A schematically illustrates a second set 650 of complex amplitudes 655-*n*. FIG. 6A shows a second set 630 of frequencies 635-*n*, a second set of basis functions 640, and a second set 650 of complex amplitudes 655-*n*.

The second set 630 of frequencies 635-*n* comprises a plurality of frequencies 635-*n*, $F_0$, $F_1$, . . . . For the purposes of discussion an arbitrary frequency 635-*n* from the plurality of frequencies will be referred to herein as $F_k$. The separation between adjacent frequencies 635-*n* in the second set 630 of frequencies 635-*n* (or spacing of the second set 630 of frequencies 635-*n*) may be less than the separation between adjacent frequencies 435-*n* in the set 430 of frequencies 435-*n* (or spacing of the set 430 of frequencies 435-*n*). For example, the separation may be given by the mathematical relation $F_k-F_{k-1}=1/PT$, where T is the duration of the transient 101 and P is a positive number. P (referred to herein as the refine factor) may be an integer number. In particular, each frequency 635-*n* in the second set 630 of frequencies 635-*n* may follow the relation $F_k=k/PT$, where k is an integer number. In particular, the spacing of the second set of frequencies may be less than the inverse of the duration of the transient signal.

It will be appreciated that the second set 630 of frequencies 635-*n* may not be equally spaced. In other words the separation between adjacent frequencies 635-*n* may not be constant. In this case the separation described above may refer to the "minimum separation" i.e. the arithmetic difference between the two closest frequencies 635-*n* in the second set 630 of frequencies 635-*n*.

The second set of basis functions 640 is similar to the set of basis functions 440 described previously with reference to FIG. 4C except as for the following. For the purposes of discussion an arbitrary basis function 645-*n* from the second set 640 of basis functions 645-*n* will be referred to herein as $g_k$. Each basis function 645-*n* of the second set 640 of basis functions 645-*n* corresponds to a respective frequency 635-*n* of the second set 630 of frequencies 635-*n*. Therefore, the basis functions 645-*n* may follow the relation:

$$g_k(t)=e^{2\pi i F_k t}$$

The second set 650 of complex amplitudes 655-*n* comprises a plurality of complex amplitudes 655-*n*, $a_0$, $a_1$, . . . . For the purposes of discussion an arbitrary complex amplitude 655-*n* from the plurality of complex amplitudes will be referred to herein as $a_k$. Each complex amplitude 655-*n* of the second set 650 of complex amplitudes 655-*n* corresponds to a respective frequency 635-*n* of the second set 630 of frequencies 635-*n*. Each complex amplitude 655-*n* of the second set 650 of complex amplitudes 655-*n* corresponds to a respective basis function 645-*n* of the second set of basis functions.

Figure 6B:
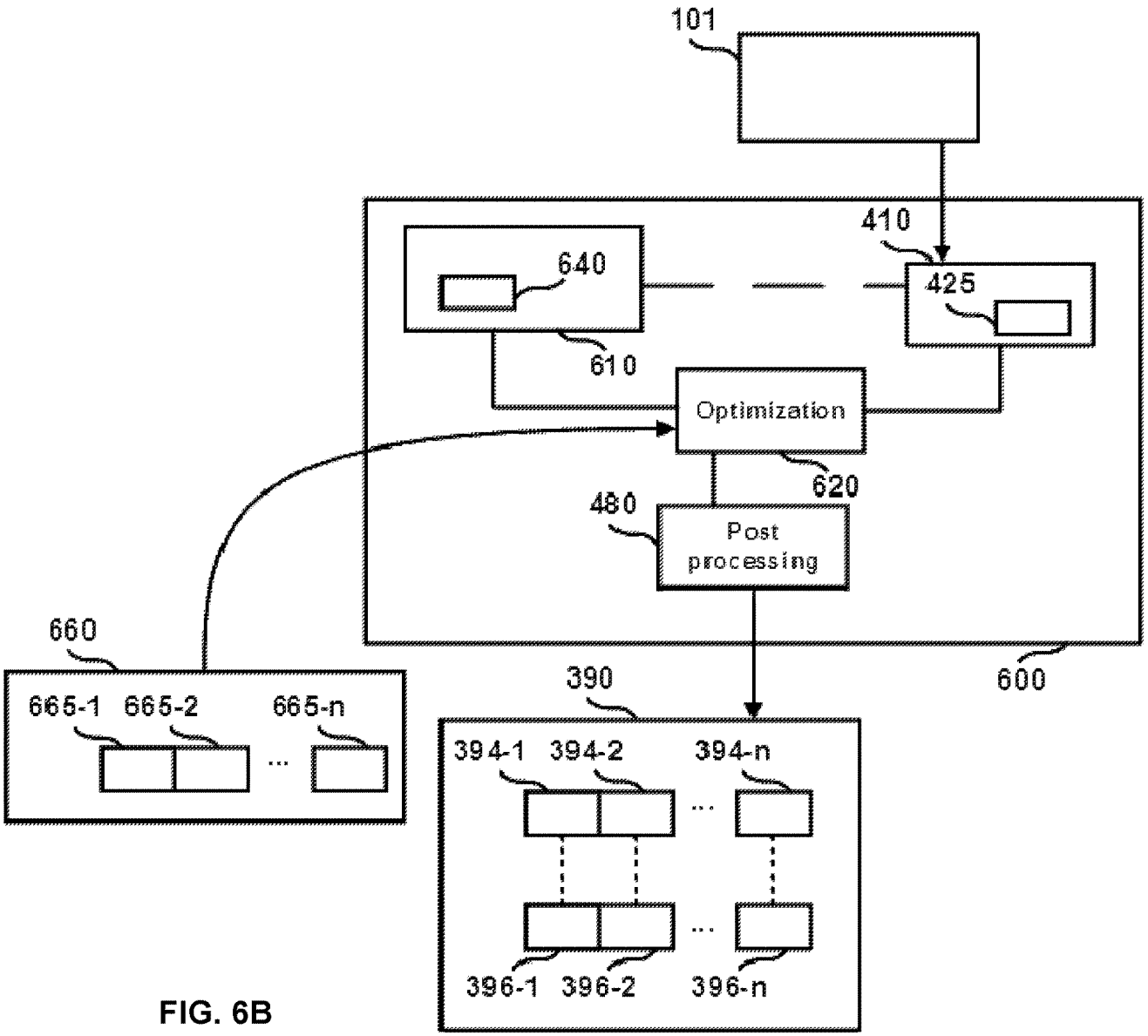
FIG. 6B schematically illustrates an exemplary transient processing system according to one embodiment of the invention.

FIG. 6B schematically illustrates an exemplary transient processing system 600 according to one embodiment of the invention. The system 600 is the same as the system 400 of FIG. 4B, except as described below. Therefore, features in common to the system 600 and the system 400 have the same reference numeral and shall not be described again. In particular, the system 600 further comprises a generation module 610 and an optimization module 620. FIG. 6B also shows expected phase data 660.

The expected phase data 660 comprises one or more expected phases 665-*n*. For the purposes of discussion an arbitrary expected phase 665-*n* will be referred to herein as $\phi_l$. Each expected phase 665-*n* corresponds to a respective frequency 635-*n* of the second set 630 of frequencies 635-*n*. Each expected phase 665-*n* may be generated (or calculated or determined) based on any of: the arrangement of the mass spectrometer 10; a signal detection method; a measured phase of one or more harmonic spectral components in the transient; a measured phase of one or more harmonic spectral components in any transient obtained in this mass spectrometer before or after obtaining the processed transient; or experimental conditions. In particular, each expected phase 665-*n* may be calculated based on any of: the method of injection of and/or excitation of the ions within the mass spectrometer 10; at least part of a time of flight of the ions in the mass spectrometer; the angular displacement between the excitation electrodes and the detection electrodes in the mass spectrometer 10. Each expected phase 665-*n* may correspond to a respective expected phase value at the respective frequency 635-*n* in the frequency domain of the transient 101. In particular, each phase value may be dependent on any of: local space-charge conditions, global space-charge conditions, etc.

It will be appreciated that it is known that the phase value of a periodic signal in a transient 101 can be dependent on m/z ratio of the ionic species of the coherent ion packet corresponding to the periodic signal. Therefore, the phase value of a periodic signal in a transient 101 can be dependent on the characteristic frequency of the periodic signal. It will, therefore be appreciated that the expected phases 665-*n* may be calculated based on such phase values. Many approaches to such calculation are known in the art (see for example, "Autophase: An algorithm for automated generation of absorption mode spectra for FT-ICR MS" D. P. A. Kilgour, R. Wills, Y. Qi, and P. B. O'Connor, *Analytical Chemistry* 2013 85 (8), pp 3903-3911 the entire contents of which are incorporated herein by reference; and "Enhanced Fourier transform for ORBITRAP mass spectrometry", O. Lange, E. Damoc, A. Wieghaus, A. Makarov *International Journal of Mass Spectrometry*, Volume 369 (2014) pp 16-22, the entire contents of which are incorporated herein by reference; U.S. Pat. No. 8,853,620 the entire contents of which are incorporated herein by reference; U.S. Pat. No. 8,399,827 the entire contents of which are incorporated herein by reference; and U.S. Pat. No. 8,431,886 the entire contents of which are incorporated herein by reference). Each expected phase 665-*n* may be stored in the storage medium 306. Additionally, or alternatively, an expected phase 665-*n* may be calculated (or otherwise determined) based on a function of the frequency 635-*n* or the index n. Preferably, an expected phase 665-*n* is calculated based on a polynomial function of the frequency 635-*n* or the index n. The coefficients of the polynomial function may be calculated (or known or otherwise determined) from the arrangement of the mass spectrometer 10. The coefficients of the polynomial function may be calculated based on a best fitting to the arguments of one or more of the complex amplitudes 455-*n*. The polynomial function may take into account space-charge correction. In particular space-charge correction may be introduced in the form of additional variables based on any of: intensity values, automatic gain control (AGC) readings, etc.

It will be appreciated that whilst the expected phase data 660 above has been described as comprising one or more expected phase values 665-*n*, this is only one example of how the expected phase data may be represented. In particular, the expected phase data 660 may also, or alternatively, be represented as a smooth varying function of frequency $\phi(f)$.

The generation module 610 is arranged to generate (or initialize) a second set 650 of complex amplitudes 655-*n*. The second set 650 of complex amplitudes 655-*n* are as described previously with reference to FIG. 6A. The generation module 610 may be arranged to set one or more (or all) of the complex amplitudes 655-*n* of the second set 650 of complex amplitudes 655-*n* to zero (or values substantially close to zero). Additionally, or alternatively, the generation module 610 may be arranged to use the Fourier transform module 410 as is indicated in the figure by the dashed line connecting the generation module 610 and the Fourier transform module 410.

The optimization module 620 is arranged to optimize the second set 650 of complex amplitudes 655-*n* to produce an improved second set 650 of complex amplitudes 655-*n*. The optimization module may be arranged to use an objective function that relates the complex amplitudes 655-*n* of the second set 650 of complex amplitudes 655-*n* to the complex amplitudes 455-*n* from the set 450 of complex amplitudes 455-*n*. The objective function may, for each frequency 435-*n* in the set 430 of frequencies 435-*n*, relate the complex amplitudes 655-*n* of the second set 650 of complex amplitudes 655-*n* to the respective complex amplitude 455-*n* from the set 450 of complex amplitudes 455-*n*. The objective function may comprise a matrix (or function) $\Psi(n,k)$ (herein referred to as the "overlap function").

The objective function may depend on the norms of one or more vectors. Each vector may correspond to respective complex amplitude 455-*n* from the set 450 of complex amplitudes 455-*n*. Each element of a vector may comprise the difference between a respective complex amplitude 655-*n* of the second set 650 of complex amplitudes 655-*n* scaled with the overlap function and the complex amplitude 455-*n* corresponding to the vector. For example, the objective function may obey the relation:

$$B(\{\alpha\}) = \sum_n \left\| \sum_k \Psi(n, k) a_k - s_n \right\|$$

A norm, $\| \ldots \|$, may be any convex norm. In particular the norm may be an $L_m$ norm i.e. any one of an $L_1$ norm; an $L_2$ norm; an $L_3$ norm; etc. If the norm is an $L_p$ norm, then the objective function may obey the relation:

$$B(\{\alpha\}) = \sum_n \left| \sum_k \Psi(n, k) a_k - s_n \right|^p$$

The overlap function may depend on one or more basis functions 445-*n* from the set of basis functions 440 and one or more basis functions 645-*n* from the second set 640 of basis functions 645-*n*. In particular, the overlap function may comprise one or more overlaps of a respective basis function 445-*n* from the set 440 of basis functions 445-*n* and a respective basis function 645-*n* from the second set 640 of basis functions 645-*n*. An overlap may comprise the inner product of the respective basis function 445-*n* from the set 440 of basis functions 445-*n* and the respective basis function 645-*n* from the second set 640 of basis functions 645-*n*, i.e. the overlap function may obey the relation $\Psi(n,k)=\langle h_n, g_k \rangle$. The inner product may be taken over the duration of the transient 101. For example the overlap function may obey the relation:

$$\Psi(n, k) = \frac{1}{T} \int_0^T e^{-2\pi i f_n t} e^{2\pi i F_k t} \, dt$$

which may also be represented as:

$$\Psi(n, k) = \frac{1}{2\pi i T} \frac{e^{2\pi i (F_k - f_n) T} - 1}{F_k - f_n}$$

It will be appreciated that the overlap function $\Psi(n,k)$ may be a Fourier image of the basis function (with the index k) 645-*n* of the second set 640 of basis functions 645-*n* in relation to the basis function (with the index n) 445-*n* of the first set 440 of basis functions 445-*n*. The overlap function $\Psi(n,k)$ may be represented as a N×(NP) complex-value matrix $\Psi$.

Figure 7:
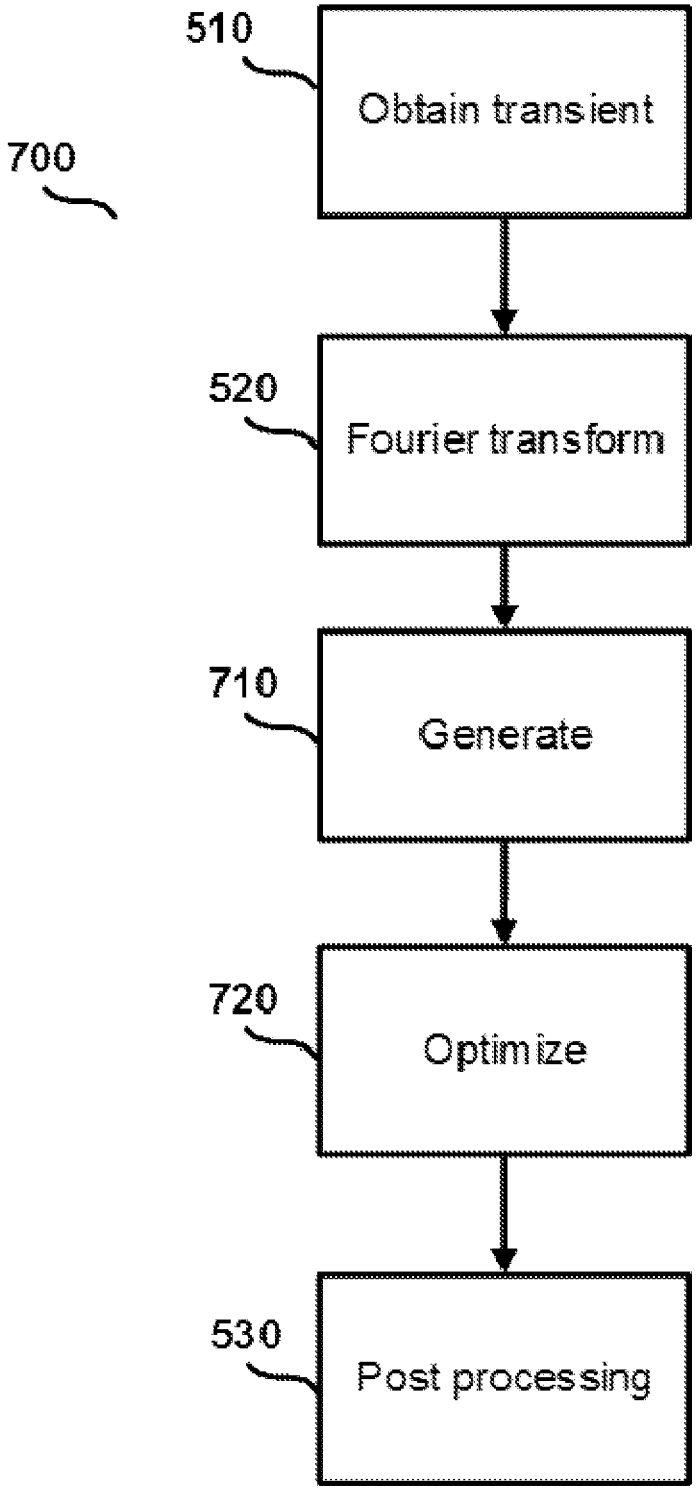
FIG. 7 is a flow diagram schematically illustrating a method for processing a transient using the system shown in FIG. 6B.

FIG. 7 is a flow diagram schematically illustrating an example method 700 for using the system 600 of FIG. 6B. The method 700 is the same as the method 500 of FIG. 5, except as described below. Therefore, steps in common to the method 700 and the method 500 have the same reference numeral and shall not be described again, except where variations on those steps are possible in the system 600.

A step 710 comprises the generation module 610 generating the second set 650 of complex amplitudes 655-*n*. The second set 650 of complex amplitudes 655-*n* may be generated based on one or more predetermined values. The second set 650 of complex amplitudes 655-*n* may be generated based on the Fourier transform of a model transient. The model transient may be generated based on user specified one or more predetermined m/z values and one or more predetermined relative abundances. The second set 650 of complex amplitudes 655-*n* may be generated based on the Fourier transform 420 of the transient 101. Additionally, or alternatively, one or more (or all) of the complex amplitudes 655-*n* of the second set 650 of complex amplitudes 655-*n* may be set to zero (or values substantially close to zero).

A step 720 comprises the optimization module 620 optimizing the second set 650 of complex amplitudes 655-*n* to produce an improved second set 650 of complex amplitudes 655-*n*. The step 720 may comprise varying one or more complex amplitudes 655-*n* of the second set 650 of complex amplitudes 655-*n* with the aim of obtaining (or achieving or generating) an extremum value of the objective function. The improved second set 650 of complex amplitudes 655-*n* may be set to (or comprise or otherwise be equivalent to) the resulting complex amplitudes. The extremum value of the objective function may be a value of the objective function where the rate of change of the value of the objective function with respect to one or more of the complex amplitudes 655-*n* is substantially zero. In this exemplary embodiment, the extremum value of the objective function is be a global minimum. However, this need not be the case. For example, the extremum value of the objective function may be a local minimum, a global maximum, or a local maximum.

The optimizing is subject to one or more constraints based on the expected phase data 660. Each of the one or more constraints may correspond to a respective expected phase 665-*n* of the expected phase data 660. Each of the one or more constraints may correspond to a respective complex amplitude 655-*n* of the improved second set 650 of complex amplitudes 655-*n*. In particular the optimizing may be subject to, for at least some of the complex amplitudes 655-*n* of the second set 650 of complex amplitudes 655-*n*, a constraint on the phase of each complex amplitude 655-*n* relative to a respective expected phase 665-*n*. A constraint may require (or impose or set or otherwise enforce) the phase of the respective complex amplitude 655-*n* of the improved second set 650 of complex amplitudes 655-*n* be equal to the respective expected phase 665-*n* of the expected phase data 660. For example such a constraint may be represented as:

$$\arg a_k = \phi_k$$

It will be appreciated that such a constraint can be imposed in many different, mathematically equivalent, ways. For example, for an arbitrary complex amplitude 655-*n* $a_k$ with a corresponding expected phase 665-*n* $\phi_k$, the expected phase may be incorporated into the basis function 645-*n* corresponding to the complex amplitude 655-*n*. In particular, the phase of the basis function may be set equal to the expected phase. Thus, the constraint corresponding to the complex amplitude 655-*n* may require the complex amplitude 655-*n* to be real valued and of a particular sign.

One or more $\phi_k$ may be (but not necessarily are) zero; in this particular case one or more $a_k$ are non-negative real numbers. One or more $\phi_k$ may be (but not necessarily are) equal to 180 degrees; in this particular case one or more $a_k$ are non-positive real numbers.

Alternatively, a constraint may require (or impose or set or otherwise enforce) the phase of the respective complex amplitude 655-*n* of the improved second set 650 of complex amplitudes 655-*n* be within a predefined range around (or substantially centred on, or within, or otherwise based on) the respective expected phase 665-*n* of the expected phase data 660. For example, such a constraint may be represented as:

$$\phi_k - \Delta\phi \leq \arg a_k \leq \phi_k + \Delta\phi$$

The range may be any of: set by a user; based on the mass spectrometer 10; dependent on the frequency corresponding to the expected phase 665-*n*; based on the expected phase jitter of the mass spectrometer 10; etc. A complex amplitude 655-*n* $a_k$, which is zero, may be considered as satisfying any phase constraint.

It will be appreciated that the step 720 may be mathematically equivalent to generating a further set 450 of complex amplitudes 455-*n*. Each complex amplitude of the set of further complex amplitudes may correspond to a respective frequency 435-*n* from the set 430 of frequencies 435-*n*. For the purposes of discussion, an arbitrary complex amplitude of the further set 450 of complex amplitudes 455-*n* will be referred to herein as $s'_n$. Each complex amplitude of the further set 450 of complex amplitudes 455-*n* may comprise the sum of one or more complex amplitudes 655-*n* of the second set 650 of complex amplitudes 655-*n*, where each of the one or more complex amplitudes 655-*n* is scaled by the overlap function. For example, $s'_n = \Sigma_k a_k \Psi(n,k)$. The improved second set 650 of complex amplitudes 655-*n* may be formed from varying one or more complex amplitudes 655-*n* of the second set 650 of complex amplitudes 655-*n*. This is performed with the aim of minimizing the sum of the norm of each difference between a complex amplitude of the further set 450 of complex amplitudes 455-*n* and the corresponding complex amplitude 455-*n* of the set 450 of complex amplitudes 455-*n*. The phase of each complex amplitude 655-*n* of the improved second set 650 of complex amplitudes 655-*n* may be constrained to be substantially equal to a respective expected phase 665-*n* of expected phase data 660.

It will be appreciated that the step 720 may be implemented using a numerical optimization technique of which many examples are known in the art. In particular the step 720 may be implemented using (or comprise or be based on) an iterative method (or procedure). As such, the optimization described above may not actually obtain an extremum value of the objective function. The optimization described above may be complete (or successful or may terminate) when a value of the objective function is obtained that is suitably close (or estimated to be suitably close) to an extremum value (or estimated or predicted extremum value) of the objective function. If the step 720 is implemented using an iterative method the optimization described above may be complete if any of the following conditions are met:

(a) a predefined number of iterations is exceeded or met;
(b) the change in the value of an objective function with respect to a previous iteration is below a predefined threshold;
(c) the change in value (or values) of one or more complex amplitudes 655-*n* of the improved second set 650 of complex amplitudes 655-*n* with respect to a previous iteration is below a predefined threshold;
(d) the change in value of one or more functions, each depending on one or more complex amplitudes 655-*n* of the improved second set 650 of complex amplitudes 655-*n*, with respect to a previous iteration is below a predefined threshold;
(e) a predefined amount of time has elapsed;
(f) a predefined number of processor cycles have elapsed; etc.

For example, the step 720 may be implemented, in whole or in part, using any of: a finite differences method e.g. such as Newton's method; a Quasi-Newton method; a conjugate gradient method; a steepest descent method; proximal minimization etc. Any of these methods may be combined with projection onto the domain of amplitudes that satisfy the phase restrictions. Preferably, the numerical optimization technique comprises a plurality of steps, each of which can be implemented using either component-wise updates of the second set 650 of complex amplitudes 655-*n* and/or vector and matrix operations that can be reduced to Fast Fourier Transform operations. This, advantageously, enables the optimization to be carried out parallel computing hardware (e.g. general purpose graphical processing unit-type systems). Thus, enabling improved computational efficiency and better computational scaling with respect to the number of complex amplitudes in the second set 650 of complex amplitudes 655-*n* (and hence the separation of the second frequency grid). A particular embodiment of the invention uses the alternating direction method of multipliers (ADMM) method and is described in further detail below.

It will be appreciated that the second set 650 of complex amplitudes 655-*n* and the improved second set 650 of complex amplitudes 655-*n* may be the same entity. In particular, the improved second set 650 of complex amplitudes 655-*n* may be the values of the second set 650 of complex amplitudes 655-*n* after the step 720. Put another way, the step 720 may comprise varying the second set 650 of complex amplitudes 655-*n* directly and the improved second set 650 of complex amplitudes 655-*n* being the varied second set 650 of complex amplitudes 655-*n*.

It will be appreciated that the second set 650 of complex amplitudes 655-*n* generated in the step 710 may be seen as providing an initial starting point (or guess) to the optimization described in the step 720. As such there are many ways known in the art for generating starting points for optimization processes. Therefore, the skilled person would appreciate that the description of the step 710 above is exemplary and may be modified or changed.

In the step 530 the improved second set 650 of complex amplitudes 655-*n* are used in place of the set 450 of complex amplitudes 455-*n*. Additionally the second set 630 of frequencies 635-*n* is used in place of the set 430 of frequencies 435-*n*.

Thus the method 700 enables the relative abundance of ionic species present in the ion source 20 to be determined from the transient 101 produced by the mass spectrometer 10. In particular, the method 700 significantly increases the accuracy of the m/z values 394-*n* and relative abundances 396-*n* compared to those produced by method 500. This is achieved by decomposing the transient 101 onto a second set 630 of frequencies 635-*n* which has a P-times smaller separation than the set 430 of frequencies 435-*n* used in method 500 (the Fourier grid corresponding to the duration of the transient 101). The method 700 results in a true decomposition onto the second set 630 of frequencies 635-*n*, rather than a simple interpolation onto the second set 630 of frequencies 635-*n* such as that produced by the zero-padding approach described previously. Therefore, frequency resolution is improved with the method 700. In particular, the method of 700 enables pairs of characteristic frequencies whose separation is 2/PT or greater to be resolved. Thus, the method 700 enables a P-times improvement of the frequency resolving power of the method 500.

Figure 8:
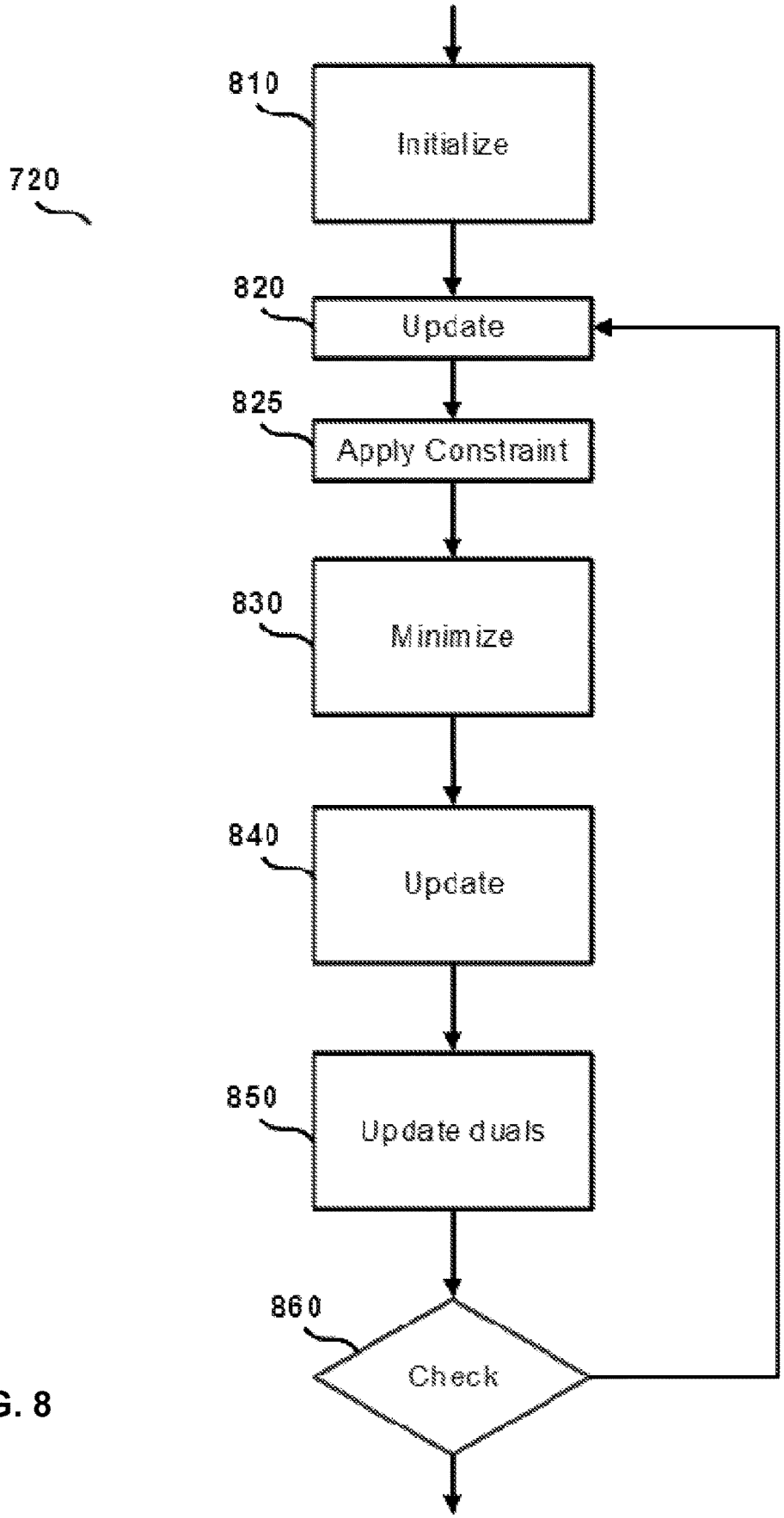
FIG. 8 is a flow diagram schematically illustrating an example implementation of an optimization process for use in the method shown in FIG. 7.

FIG. 8 is a flow diagram schematically illustrating an example implementation of the optimization step 720 in method 700. In this example the objective function to be minimized is $B(\{a\})=\Sigma_n\|\Sigma_k\Psi(n,k)a_k-s_n\|$. In this example the optimization step 720 uses the Alternating Direction Method of Multipliers (ADMM). This general method is well known in the art (see for example "*A dual algorithm for the solution of nonlinear variational problems via finite element approximation*" Gabay and Mercier, Computers and Mathematics with Applications, vol. 2, pp. 17-40, 1976, the entire contents of which are incorporated herein by reference). The general form of the regularized augmented Lagrangian consistent with ADMM is well known. In this particular case the regularized augmented Lagrangian may be written as:

$$\mathcal{L}(a, y, z, w, u, v) = \sum_n \|y_n\| + \sum_k I(a_k, \phi_k) + \rho\mathrm{Re}\sum_k u_k(a_k - z_k) + \rho\mathrm{Re}\sum_n v_n(y_n - w_n) + \frac{\rho}{2}\|a - z\|_2^2 + \frac{\rho}{2}\|y - w\|_2^2$$

with extra condition $w_n=\Sigma_k\Psi(n,k)z_k-s_n$. Here the following will be appreciated:

$I(a_k,\phi_k)$ is an indicator function, which may be thought of as reflecting the phase constraints;

$$a = \begin{pmatrix} a_0 \\ a_1 \\ \vdots \\ a_{N\times P-1} \end{pmatrix}$$

i.e. a plain a represents the vector of all of the complex amplitudes of the second set 650 of complex amplitudes 655-*n*;

$$y = \begin{pmatrix} y_0 \\ y_1 \\ \vdots \\ y_{N-1} \end{pmatrix}$$

where each $y_n$ may be a complex number. Vector y may be thought of as corresponding to the discrepancy between a and s;

$$v = \begin{pmatrix} v_0 \\ v_1 \\ \vdots \\ v_{N-1} \end{pmatrix}$$

where each $v_n$ may be a complex number. Vector v may be known as a "dual variable". Vector v may be thought of as a vector of Lagrange multipliers;

$$u = \begin{pmatrix} u_0 \\ u_1 \\ \vdots \\ u_{N\times P-1} \end{pmatrix}$$

where each $u_k$ may be a complex number. Vector u may be known as a "dual variable". Vector u may be thought of as a vector of Lagrange multipliers;

$$w = \begin{pmatrix} w_0 \\ w_1 \\ \vdots \\ w_{N-1} \end{pmatrix}$$

where each $w_n$ may be a complex number;

$$z = \begin{pmatrix} z_0 \\ z_1 \\ \vdots \\ z_{N\times P-1} \end{pmatrix}$$

where each $z_k$ may be a complex number;

IP may be an N×NP matrix form of the overlap function $\Psi(n,k)$—i.e. $\Psi_{nk}=\Psi(n,k)$;

$$s = \begin{pmatrix} s_0 \\ s_1 \\ \vdots \\ s_{N-1} \end{pmatrix}$$

i.e. a plain s represents the vector of all of the complex amplitudes of the set 450 of complex amplitudes 455-*n*; and ρ is a regularization parameter.

The regularization parameter is greater than zero. In particular, the regularization parameter may depend on the objective function. For example, if the objective function is squared $L_2$ norm, the regularization parameter may be in the range $10^{-3}$ to $10^{-1}$. If the objective function is $L_1$ norm, the regularization parameter may be in the range $10^{-3}\times s_{max}$ to $10^{-1}\times s_{max}$, where $s_{max}$ is the maximal absolute value (or an estimate of the maximal absolute value) of the spectrum 420. The regularization parameter may vary from iteration to iteration.

The indicator function may follow the relation:

$$I(a_k, \phi_k) = \begin{cases} 0 & \text{if } \phi_k - \Delta\phi \le \arg a_k \le \phi_k + \Delta\phi \\ +\infty & \text{everywhere else} \end{cases}$$

Put another way the indicator function may be zero within the cone in complex space defined as: $\arg a_k \in [\phi_k-\Delta\phi_k+\Delta\phi]$, and plus infinity outside this cone. Consistent with the ADMM a dual function may be written as:

$$p(u, v) = \min_{a,y,z} \mathcal{L}(a, y, \Psi z - s, w, u, v)$$

A step 810 comprises setting the vectors a, y, z, u, and v to some initial values. These values may be zero. However, it would be appreciated that for a convex objective function and feasibility domain any choice of initial conditions may lead to convergence.

A step 820 comprises updating the complex amplitudes $a_k$ 655-*n* of the improved second set 650 of complex amplitudes based on the vector z; and the vector u. In particular, the step 820 may comprise updating the complex amplitudes $a_k$ 655-*n* of the improved second set 650 of complex amplitudes 655-*n* in accordance with the formula:

$$a_k := z_k - u_k$$

A step 825 comprises applying the one or more constraints as described previously with reference to FIG. 5. In particular, the step 825 may comprise, for each of the one or more constraints, applying the constraint to a respective complex amplitude of the second set 650 of complex amplitudes 655-*n*. For example, the step 820 may comprise, for each complex amplitude 655-*n*, $a_k$, of the second set 650 of complex amplitudes 655-*n*, projecting that complex amplitude 655-*n* onto the cone in complex space defined as $\arg a_k \in [\phi_k-\Delta\phi, \phi_k+\Delta\phi]$. In the case that the amplitude $a_k$ already belongs to said cone, the amplitude may stay unchanged.

A step 830 comprises minimization of the Lagrangian with respect to the variables $y_n$. The vector y may be updated element-wise based on the elements $w_n$ and $v_n$. Herein "updating" can refer to any process or step where a variable (such as any of; a vector; a component of a vector; a scalar etc.) is given (or set or calculated) a new value (or values). Herein, "element-wise" refers to any process or step where each component (or element) of a vector (or matrix) is updated independently of each other component of the vector (or matrix). It will be appreciated that such updates can be carried out: in serial; in parallel or as a mix of serial and parallel operations. In particular, each component $y_k$ of the vector y may be updated using a proximal operator. The proximal operator may be dependent on the regularization parameter and the objective function. For example, each component $y_k$ of the vector y may be updated using following relation:

$$y_k := \operatorname{argmin}\left(\| y_k \| + \frac{\rho}{2} | y_k - w_k + v_k |^2\right) = prox_\rho(w_k - v_k)$$

Typically, the proximal operator depends on the choice of the objective function. For instance, if the objective function comprises the squared $L_2$ norm, the explicit form of the proximal operator is $$prox(x) = \frac{\rho}{2+\rho} x.$$

If the objective function comprises the $L_1$ norm, the explicit form of the proximal operator is $$prox(x) = \begin{cases} 0, & |x| \le 1/\rho \\ (1 - (\rho|x|)^{-1})x, & |x| > 1/\rho \end{cases}$$

A step 840 comprises updating the vector z based on one or more complex amplitudes 655-*n* of the second set 650 of complex amplitudes 655-*n*; the vector u; the vector v and the vector y. The step 840 also comprises updating the vector w based on the complex amplitudes of the second set 650 of complex amplitudes 655-*n*; the vector u; the vector v and the vector y. In particular, the step 840 may comprise calculating a first intermediate vector, $\tilde{z}$, based on one or more complex amplitudes 655-*n* of the second set 650 of complex amplitudes 655-*n*; and the vector u. The first intermediate vector, $\tilde{z}$, may follow the relation:

$$\tilde{z} = a + u$$

The step 840 may comprise calculating a second intermediate vector, $\tilde{w}$, based on one or more complex amplitudes of the second set 650 of complex amplitudes 655-*n*; and the vector u. The second intermediate vector, $\tilde{w}$, may follow the relation:

$$\tilde{w} = y + v$$

The step 840 may comprise an orthogonal projection the first intermediate vector and the second intermediate vector onto a hyperplane. The hyperplane may be based on the overlap function and the set 450 of complex amplitudes 455-*n*. In particular, the hyperplane may be defined as: $w=\Psi z-s$. Vector z may be updated based on the orthogonal projection. Vector w may be updated based on the orthogonal projection. For example, step 840 may comprise updating vector z using the following relation:

$$z=\tilde{z}-\overline{\Psi}^T r$$

Step 840 may comprise updating vector w may be updated using the following relation:

$$w:=\tilde{w}+r$$

Step 840 may comprise calculating the vector r using the relation:

$$r=(1-P)^{-1}(\Psi\tilde{z}-s-\tilde{w})$$

where P is as described previously in relation to FIG. 6A.

It will be appreciated that step 840 may be seen as comprising updating the vectors z and w with the aim of minimizing the Lagrangian. This update may be subject to the condition $w=\Psi z-s$. The update may be given by the formulas $$\tilde{z}_k := a_k + u_k,\ \tilde{w}_n := y_n + v_n$$

$$r := \frac{1}{P+1}(\Psi\tilde{z} - s - \tilde{w}),\ q := \overline{\Psi}^T r$$

$$z_k := \tilde{z}_k - q_k,\ w_n := \tilde{w}_n + r_n$$

It will be appreciated that the operations to calculate the intermediate values $\tilde{z}_k$, $\tilde{w}_n$ and the updates of $z_k$ and $w_n$ may be element-wise. The operations of matrix-vector multiplications by $\Psi$ and $\overline{\Psi}^T$ may be reduced to a number of FFT operations. Performing matrix-vector operations using FFT operations is well known and hence not described further in detail. Broadly however, it will be appreciated that in this case the multiplication of a vector $\tilde{z}$ by matrix $\Psi$ may comprise: (a) calculating an FFT of $\tilde{z}$, (2) discarding the elements of the FFT product following the N-th element, (3) calculating the inverse FFT, (4) ensuring the proper normalization of the result. Similarly, multiplication of a vector r by matrix $\overline{\Psi}^T$ may comprise: (1) calculating an FFT of r, (2) appending the FFT product with $N\times(P-1)$ zero elements, (3) calculating inverse FFT, (4) ensuring the proper normalization of the result.

A step 850 comprises updating the vectors u and v (also known as "the dual variables"). The vector u is updated based on one or more complex amplitudes 655-*n* of the second set 650 of complex amplitudes 655-*n*, the vector z and the current state of the vector u. In particular, the step 850 may comprise subtracting the vector z from the vector u and adding the vector a. The vector v is updated based on the vector y, the vector w and the current state of the vector v. In particular, the step 850 may comprise subtracting the vector w from the vector v and adding the vector y.

A step 860 comprises checking one or more convergence criteria. A convergence criterion may be any of:

(a) a predefined number of iterations of the steps 820 to 850 have occurred;

(b) the change in value (or values) of one or more complex amplitudes 655-*n* of the improved second set 650 of complex amplitudes 655-*n* with respect to a previous iteration is below a predefined threshold;

(c) the change in value of one or more functions, each depending on one or more complex amplitudes 655-*n* of the improved second set 650 of complex amplitudes 655-*n*, with respect to a previous iteration is below a predefined threshold;

(d) a predefined amount of time has elapsed;

(e) a predefined number of processor cycles have elapsed; etc.

The step 860 may comprise continuing the method from the step 820 if at least one of the one or more convergence criteria has been satisfied. Alternatively the optimization step 720 may be terminated. The step 860 may comprise continuing the method from the step 820 if all of the one of the one or more convergence criteria have been satisfied. Alternatively the optimization step 720 may be terminated. The step 860 may comprise returning the improved second set 650 of complex amplitudes 655-*n*. In this way it will be appreciated that an iteration procedure can be defined comprising the steps 820 to 870.

As can be seen the mathematical operations on the steps 820, 825, 830, and 850 are component wise, as discussed previously, this enables these steps to be carried out efficiently using parallel computing hardware. The step 840 may comprise multiplications of a vector by matrices $\Psi$ and $\overline{\Psi}^T$. Such operations can be reduced to Fast Fourier Transform operations and their inverses as outlined above. These FFT operations can also be carried out efficiently on parallel computing hardware. Additionally there are many optimized software libraries available for performing such FFT operations (e.g. the Fastest Fourier Transform in the West (FFTW) libraries; the FFTPACK library; the Intel Math Kernel library; etc.). In particular, time taken to perform such FFT operations can be made to scale as $N \log_2 N$ where N is the number of complex amplitudes in the second set 650 of complex amplitudes 655-*n*. Consequently the embodiment described above advantageously enables computational efficiency to be maintained even when the separation of the second set 630 of frequencies 635-*n* is reduced (and hence the resolution of the method is increased).

Figure 9:
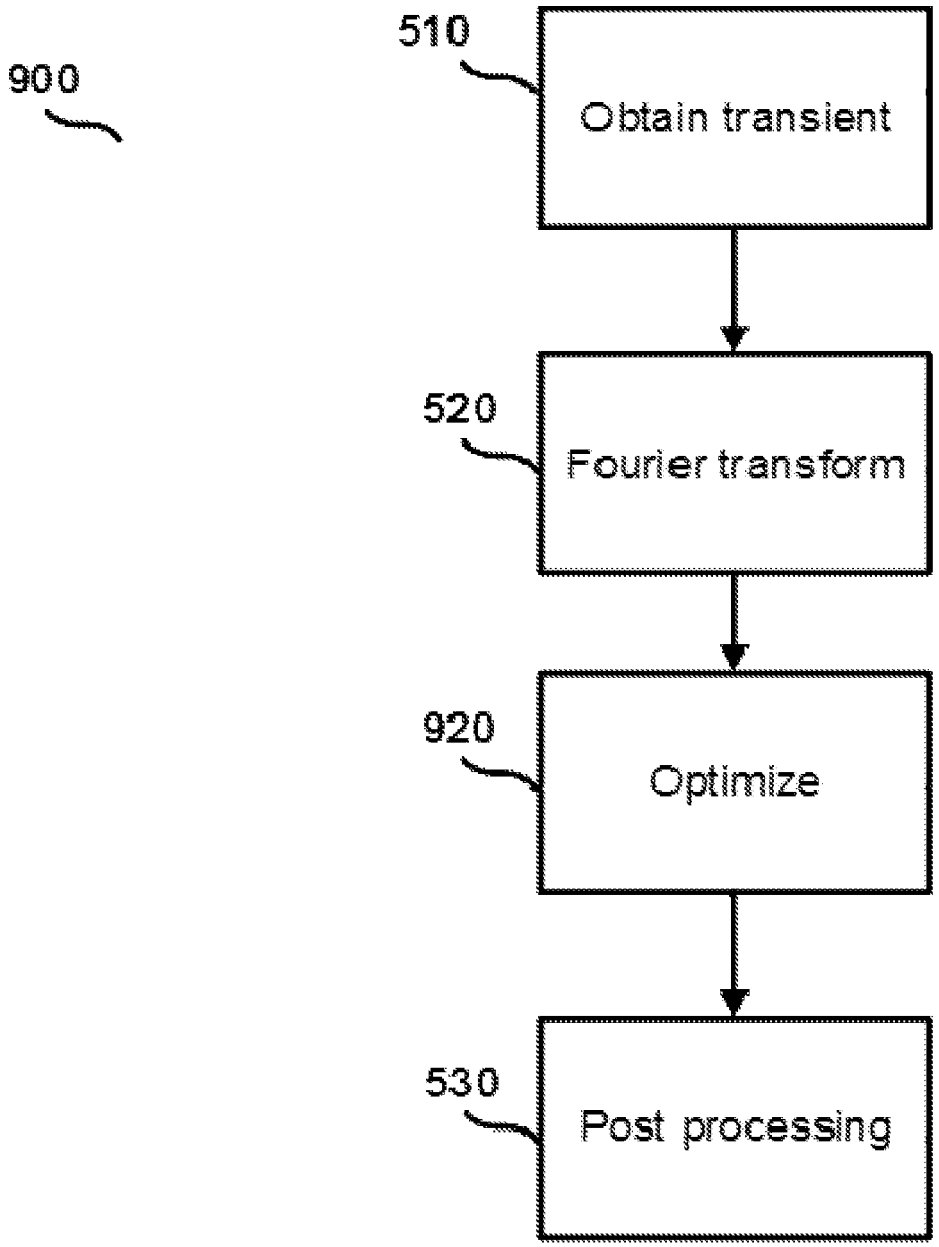
FIG. 9 is a flow diagram schematically illustrating another method for processing a transient using the system shown in FIG. 6B.

FIG. 9 is a flow diagram schematically illustrating an example method 900 for using the system 600 of FIG. 6. The method 900 is the same as the method 700 of FIG. 7, except as described below. Therefore, steps in common to the method 900 and the method 700 have the same reference numeral and shall not be described again.

A step 920 comprises the optimization module 620 optimizing the second set 650 of complex amplitudes 655-*n* to produce an improved second set 650 of complex amplitudes 655-*n*. The step 920 is the same as the step 720 of FIG. 7 except as described below.

At least one of the complex amplitudes 655-*n* (referred to herein as a "harmonic" complex amplitude for the purposes of discussions) of the second set 650 of complex amplitudes 655-*n* each comprises a respective auxiliary complex amplitude corresponding to the respective frequency and a respective "base" complex amplitude, scaled by a respective parameter (which for the purposes of discussion may be represented as $\xi$). A base complex amplitude may be a complex amplitude 655-*n* from the second set 650 of complex amplitudes 655-*n*. A base complex amplitude may be an auxiliary complex amplitude of a complex amplitude 655-*n* from the second set 650 of complex amplitudes 655-*n*.

For each base complex amplitude in the second set 650 of complex amplitudes 655-*n* the frequency 635-*n* corresponding to the harmonic complex amplitude may be equal to the frequency 635-*n* corresponding to the corresponding base complex amplitude scaled by a factor. The factor may be an integer q. Put another way, the frequency 635-*n* corresponding to the corresponding harmonic complex amplitude may be a q-th harmonic of the frequency 635-*n* corresponding to the base complex amplitude 655-*n*.

The parameter, ξ, may be dependent on the factor. The parameter may be dependent on the frequency 635-*n* corresponding to the respective base complex amplitude 655-*n*. The parameter ξ may be dependent on any of:

(a) the geometry (or arrangement) of one or more electrodes in the mass spectrometer 10 (e.g. the first outer electrode 84 and/or the second outer electrode 85);

(b) arrangement of the mass spectrometer 10;

(c) the shape of one or more periodic signals in the transient 101;

(d) at least part of one or more of the basis functions 645-*n* in the second set 640 of basis functions 645-*n*; or (e) at least part of the respective second basis function 645-*n*.

For one or more harmonic complex amplitudes 655-*n* in the second set 650 of complex amplitudes 655-*n* the optimizing of step 920 may be subject to a respective constraint on the phase of the respective auxiliary complex amplitude relative to a respective expected phase 665-*n*. In particular, the respective constraint may require the phase of the respective auxiliary complex amplitude be equal to the expected phase 665-*n* of the expected phase data 660. For example such constraints may be represented as:

$$\arg a_k^* = \phi_k$$

Alternatively, the respective constraint may require the phase of the respective auxiliary complex amplitude of the improved second set 650 of complex amplitudes 655-*n* be within a predefined range around the respective expected phase 665-*n* of the expected phase data 660. For example, such constraints may be represented as:

$$\phi_k - \Delta\phi \le \arg a_k^* \le \phi_k + \Delta\phi$$

In an example, each complex amplitude 655-*n*, $a_k$, of the second set 650 of complex amplitudes 655-*n* may obey the relation:

$$a_k = \begin{cases} a_k^* + \xi_{\frac{k}{q}} a_{\frac{k}{q}}^* & \text{if } k \text{ is a multiple of } q \\ a_k^* & \text{otherwise} \end{cases}$$

Put another way, for each complex amplitude 655-*n* in the second set 650 of complex amplitudes 655-*n* corresponding to the q-th harmonic of another complex amplitude 665-*n* in the second set 650 of complex amplitudes 655-*n*, that complex amplitude 655-*n* comprises the sum of a respective auxiliary complex amplitude and the another complex amplitude 655-*n* (or the corresponding auxiliary complex amplitude), scaled by a parameter.

In a further example, each complex amplitude, $a_k$, of the second set 650 of complex amplitudes 655-*n* may obey the relation:

$$a_k = a_k^* + \frac{\xi_{\left[\frac{k}{q}\right]}}{q} a_{\left[\frac{k}{q}\right]}^*$$

This may be regarded as distributing the q-th harmonic evenly over the complex amplitudes 655-*n* of the second set 650 of complex amplitudes 655-*n*.

As the shape of each periodic signal in the transient 101 may not be typically exactly the same as the shape of the Fourier basis functions, a single periodic signal typically contributes to a plurality complex amplitudes 455-*n* of the set 450 of complex amplitudes 455-*n* in the method 500 described previously. Put another way, a single ionic species typically generates multiple Fourier harmonics. The phase of the complex amplitudes corresponding to the harmonics generated by a single ionic species may be substantially the same. Thus for a given harmonic produced by one ionic species the contribution to the complex amplitude at that harmonic frequency may be different to the phase of the contribution to the complex amplitude at the same frequency given by another ionic species. The method 900 may improve overall accuracy, accounting for such a difference when applying phase constraints.

In some examples, it is advantageous to set q equal to three. For example in an ORBITRAP mass analyzer, the complex amplitude corresponding to the third harmonic frequency ranges between 3% and 5% of the complex amplitude of the corresponding base frequency. The presence of complex amplitudes at such harmonic frequencies can lead to false positives and lead to spurious m/z values 494 being obtained. The method 900 enables the use of the complex amplitudes 655-*n* at such harmonic frequencies 635-*n* to improve the accuracy of the decomposition relative to the method 700 and the method 500. In particular the accuracy of the complex amplitudes 655-*n* of the improved second set 650 of complex amplitudes 655-*n* generated by the method 900 is improved over the complex amplitudes 455-*n*, 655-*n* produced by the previous methods. Therefore, the mass spectra produced by the method 900 is of an improved accuracy relative to the previous methods.

Figure 10:
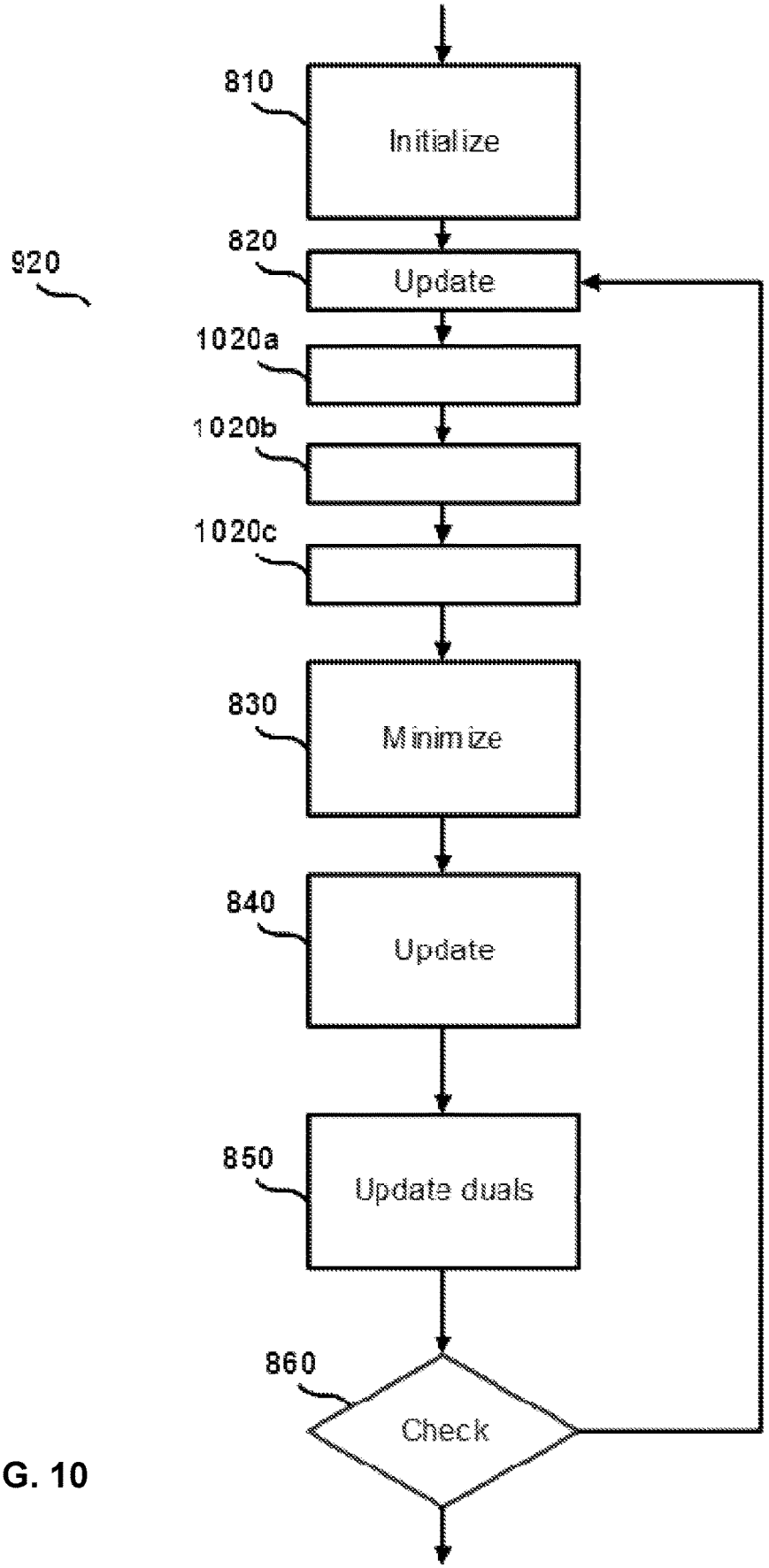
FIG. 10 is a flow diagram schematically illustrating an example implementation of an optimization process for use in the method shown in FIG. 9.

FIG. 10 is a flow diagram schematically illustrating an example implementation of the optimization step 920 in the method 900. The implementation is the same as the implementation described previously with reference to FIG. 8, except as described below. Therefore, steps in common to FIG. 10 and FIG. 8 have the same reference numeral and shall not be described again.

A step 1020*a* comprises, for each harmonic complex amplitude 655-*n* (as described previously with reference to FIG. 9) in the improved second set 650 of complex amplitudes 655-*n*, calculating the respective auxiliary complex amplitude (as described previously with reference to FIG. 9). The calculation may be based on any of: the parameter, (as described previously with reference to FIG. 9); a base complex amplitude 655-*n* corresponding to the harmonic complex amplitude; an auxiliary complex amplitude of a base complex amplitude 655-*n* corresponding to the harmonic complex amplitude; a complex amplitude 655-*n* from the improved second set 650 of complex amplitudes 655-*n*. For example, the calculation may use the relation:

$$a_k^* = a_k - \xi_{\left[\frac{k}{q}\right]} a_{\left[\frac{k}{q}\right]}^*$$

A step 1020*b* is the same as the step 820 of FIG. 8 except as described below. For one or more harmonic complex amplitudes 655-*n* the step b may comprise applying a respective constraint as described previously with reference to FIG. 9. In particular, for one or more harmonic complex amplitudes 655-*n* the step b may comprise applying the constraint to the respective auxiliary complex amplitude. For example, for one or more harmonic complex amplitudes 655-*n* the step 1020*b* may comprise projecting the respective auxiliary complex amplitude onto the cone in complex space defined as $\arg a_k^* \in [\phi_k - \Delta\phi, \phi_k + \Delta\phi]$.

It will be appreciated that applying a constraint for a harmonic complex amplitude 655-*n*, as described above in step b, may be performed instead of or in addition to, applying a constraint to that complex amplitude 655-*n* as described previously in step 820.

A step 1020*c* comprises updating one or more harmonic complex amplitudes 655-*n* of the second set 650 of complex amplitudes 655-*n*. The updating may be based on any of: the parameter, ξ; a base complex amplitude 655-*n* corresponding to the harmonic complex amplitude; an auxiliary complex amplitude of a base complex amplitude 655-*n* corresponding to the harmonic complex amplitude; a complex amplitude from the improved second set 650 of complex amplitudes 655-*n*. For example, the updating may use the relation:

$$a_k^* = a_k - \xi_{\left[\frac{k}{q}\right]} a^*_{\left[\frac{k}{q}\right]}$$

It will be appreciated that the steps a, b and c may be performed as a block component wise on the vector a. By way of an example the steps 1020*a*, 1020*b* and 1020*c* may be performed on a complex amplitude 655-*n* $a_k$ before the steps 1020*a*, 1020*b* and 1020*c* are performed on a complex amplitude 655-*n* $a_{k+1}$ and so on. The steps 1020*a*, 1020*b* and 1020*c* may be performed in parallel on one or more complex amplitudes 655-*n*. By way of an example, the step 1020*a* may be performed on a complex amplitude 655-*n* $a_k$ and a complex amplitude 655-*n* $a_{k+1}$, before the step 1020*b* may be performed on the complex amplitude 655-*n* $a_k$ and the complex amplitude 655-*n* $a_{k+1}$, and so on. Additionally, it will be appreciated that many variants on these two schemes would be considered by the skilled person.

It will be appreciated that in some embodiments of the invention, in line with the preceding description, part 425 of the discrete Fourier transform 420 may be used in place of the whole discrete Fourier transform 420 of the transient 101. In particular, the set 430 of frequencies 435-*n* may be limited to (or span) only a part 425 (or parts) of the discrete Fourier transform 420. It will be appreciated that this may be the case even if the full discrete Fourier transform 420 has been calculated (such as in the step 520). The selection of a part 425 (or parts) of the discrete Fourier transform is referred to herein as "windowing" and is described in more detail below by reference to specific examples.

Figure 11A:
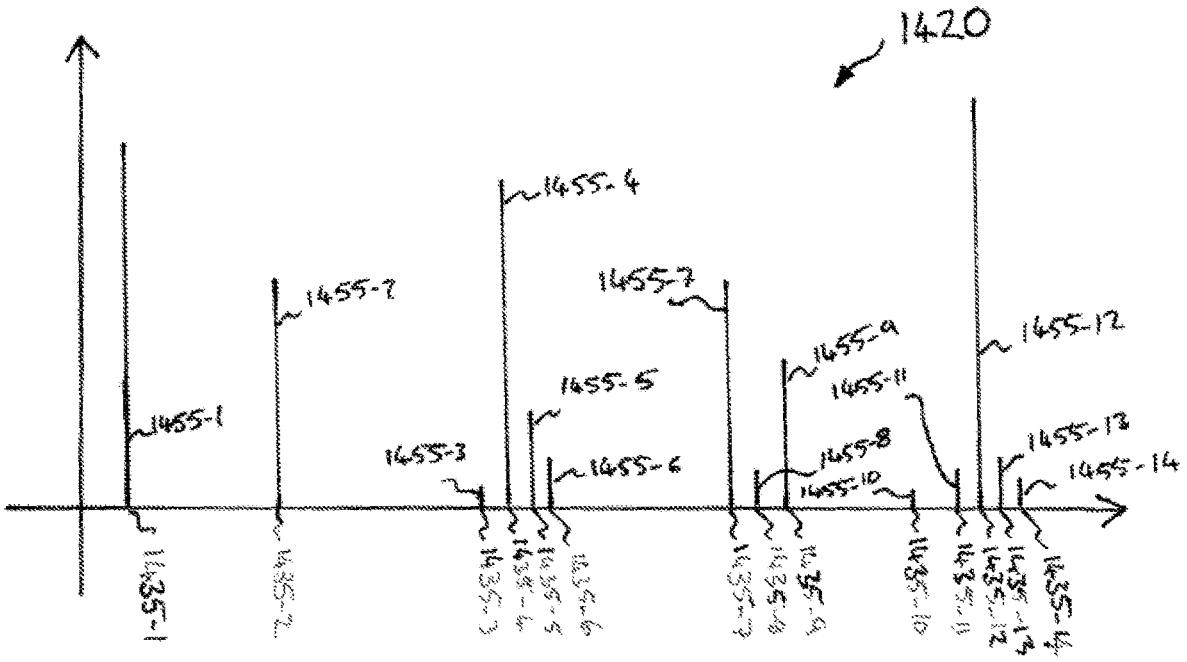
FIG. 11A schematically illustrates a spectral plot of an example that shows a discrete Fourier transform of a transient.

FIG. 11A schematically illustrates a spectral plot of an example 1420 that shows a discrete Fourier transform 420 of a transient 101. Shown is a group of complex amplitudes 1455-1, 1455-2, . . . , 1455-14 of the Fourier transform 420. Each complex amplitude 1455-1, 1455-2, . . . , 1455-6 is shown as having a corresponding frequency 1435-1, 1435-2, . . . , 1435-14. As set out above, all of the complex amplitudes 1455-1, 1455-2, . . . , 1455-14 of the Fourier transform 420 and all of the corresponding frequencies 1435-1, 1435-2, . . . , 1435-14 may be used as the set 450 of complex amplitudes 455-*n* and the set 430 of complex frequencies 435-*n* respectively.

Figure 11B:
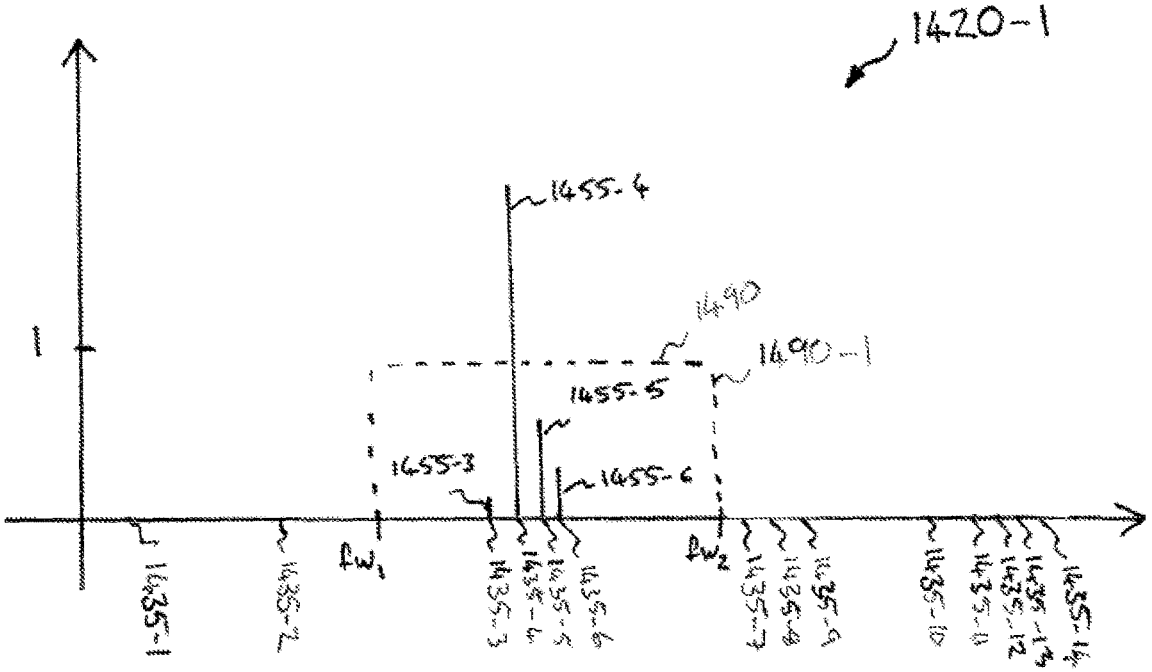
FIG. 11B schematically illustrates a spectral plot of an example part of the example discrete Fourier transform shown in FIG. 11A.

FIG. 11B schematically illustrates a spectral plot of an example 1420-1 part 425 of the example discrete Fourier transform. The example 1420-1 part 425 comprises only the complex amplitudes 1455-3, . . . , 1455-6, along with the respective frequencies 1435-3, . . . , 1455-6. In other words, the part 425 may be a windowed version of the discrete Fourier transform 420. In this case the window comprises the frequencies 435-*n* between $fw_1$ and $fw_2$. Such a part 425 (or windowed version of a discrete Fourier transform 420) may, as will be appreciated, be used in any of the methods and systems outlined previously. In such cases the set 450 of complex amplitudes 455-*n* will comprise (or in some cases consist of) the complex amplitudes 1455-3, . . . , 1455-6 of the part 425. The other complex amplitudes 1455-1, 1455-2, 1455-7 . . . , 1455-14 of the discrete Fourier transform 420 (the complex amplitudes outside of the window) may either be not present, or set to zero. Similarly, the set 430 of frequencies 435-*n* may comprise (or in some cases consist of) the frequencies 1425-3, . . . , 1435-6 of the part 425.

The forming (or generating) of such a part 425 may be considered to be equivalent to applying a windowing function 1490 to the discrete Fourier transform 420. The windowing function 1490 is typically a real-valued function of frequency. In particular, the part 425 may be the product of the window function 1490 and the discrete Fourier transform. The example 1490-1 window function 1490 shown in FIG. 11B is a normalized boxcar function, which in this case has the value 1 between the frequencies $fw_1$ and $fw_2$ and zero everywhere else.

One particular advantage of such windowing is increased processing speed and reduction of computational burden. This is due to the fact the subsequent processing need not take account of the frequency spectrum in its entirety, but only to the regions of interest. For a sparse enough spectrum or for sparse enough segments of interest, calculations can be carried only within windows of the spectrum encapsulating these regions. The use of windowing in general is known in the art and the selection of the window width in this particular case could be run automatically using algorithms known to the skilled person.

Figure 11C:
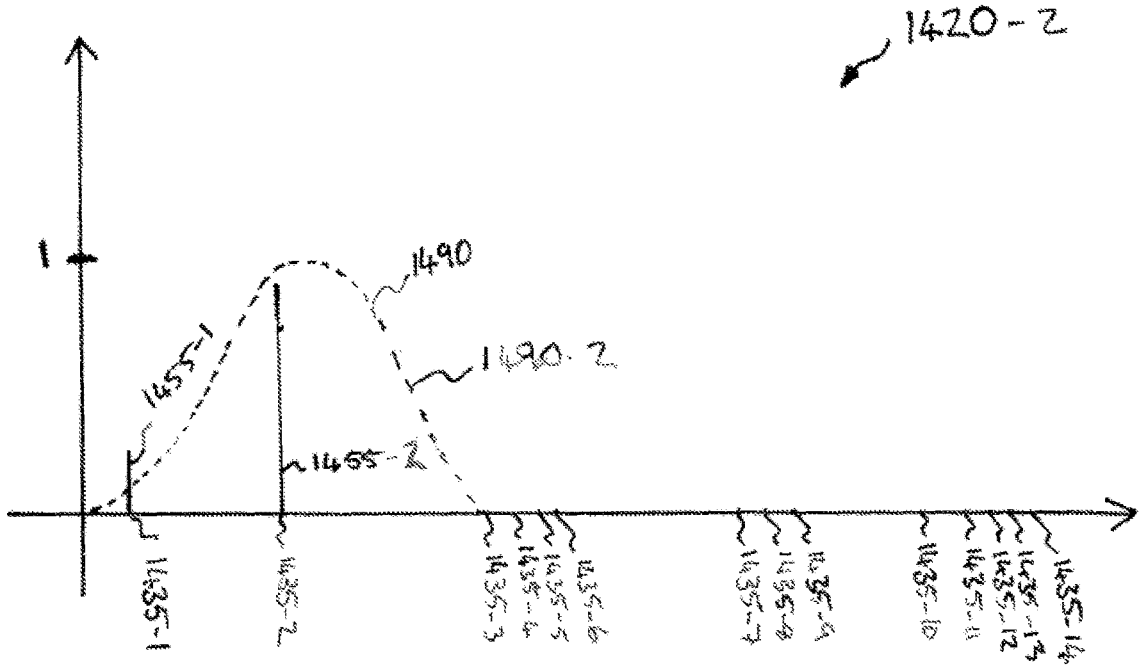
FIG. 11C schematically illustrates a spectral plot of a further example part of the example discrete Fourier transform shown in FIG. 11A.

FIG. 11C schematically illustrates a spectral plot of an example 1420-2 part 425 of the example discrete Fourier transform. The example 1420-2 part 425 is similar to the example 1420-1 described above, but illustrates an alternative form 1490-2 of windowing function 1420. Here, the example 1490-2 windowing function 1490 smoothly varies in frequency space. In this case the complex amplitudes 1455-1, 1455-2 within the window have been scaled by the example 1490-2 windowing function 1420. As a result the relative values of the complex amplitudes 1455-1, 1455-2 within the window have changed. As above, the set 450 of complex amplitudes 455-*n* will comprise (or in some cases consist of) the complex amplitudes 1455-1, . . . , 1455-2 as scaled by the example 1490-2 windowing function 1490.

The use of a windowing function whose value varies within the window, as above, has an advantage of reducing artefacts that may be introduced by the windowing relative to using a boxcar type of windowing function like that shown at 1490-1. Examples of windowing functions whose value varies within the window include any of: Gaussian functions, Hann functions, Hamming functions. It will be appreciated that a windowing function 1490 may comprise two or more functions, such as in the form of any of a sum, product, convolution and so forth.

Figure 11D:
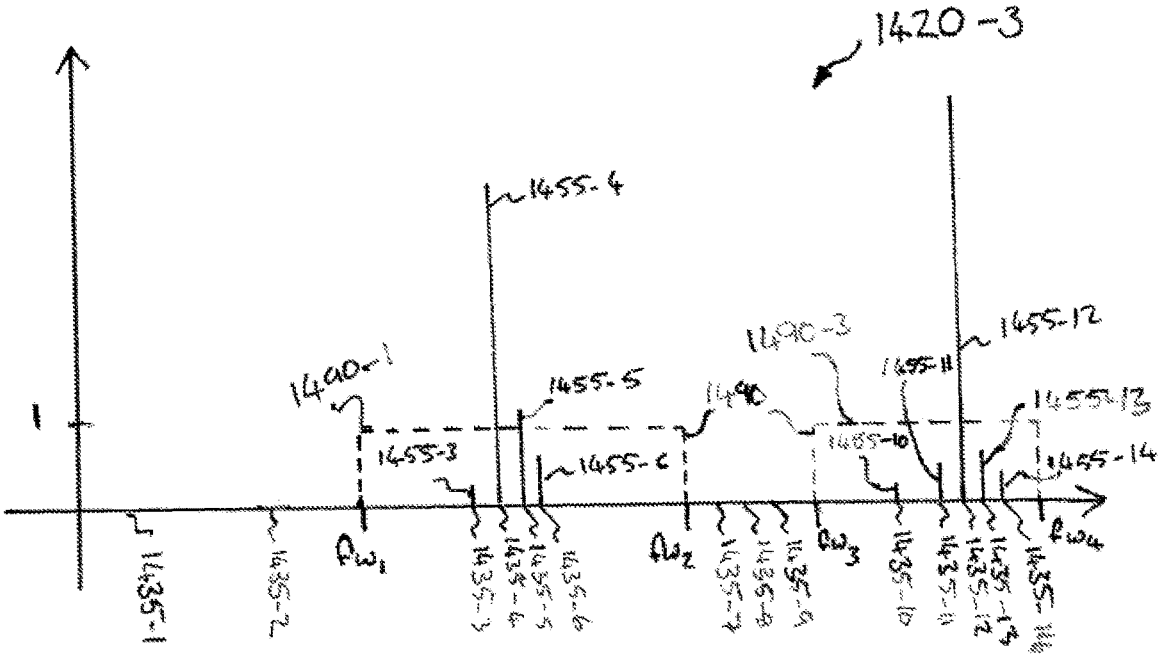
FIG. 11D schematically illustrates a spectral plot of a yet further example part of the example discrete Fourier transform shown in FIG. 11A.

FIG. 11D schematically illustrates a spectral plot of an example 1420-3 part 425 of the example discrete Fourier transform. The example 1420-3 part 425 is similar to the example 1420-1 described above but with an additional normalized boxcar function 1490-3 as part of the example 1490-2 windowing function 1420. In this case the window comprises the frequencies 435-*n* between both $fw_1$ and $w_2$, and $fw_3$ and $fw_4$.

It will be appreciated that the windowing outlined above may be done based on frequencies that are expected in some way. In particular, and as set out previously, frequency values may be mapped (or converted) to m/z values and vice versa. As such, windows may be chosen to encompass m/z values and/or ranges of interest. This may be particularly beneficial in various quantitative proteomics experiments, in particular isobaric labelling, which would be familiar to the person skilled in the art. Here, analytes are typically covalently labelled with chemical compounds. These chemical compounds are usually chosen to appear to be of the same (or substantially the same) masses. As such they may be considered to be isobaric in the m/z sense. Typically, upon fragmentation, these chemical compounds yield ions, known as reporter ions, of different m/z, which can be used for quantitative analysis of the analytes. As the m/z of these expected reporter ions are known beforehand, the windowing described above may be used advantageously. In particular, windows could be selected so as to encompass the m/z segments where reporter ions are expected to be located.

Particular examples of quantitative proteomics experiments requiring high resolution scans include any of: Isobaric Tags for Relative and Absolute Quantification (iTRAQ) experiments; Tandem Mass Tags (TMT) experiments; and Neutron-Encoded Mass Signatures for Multiplexed Proteome Quantification (NeuCode) experiments. As such, the application of the methods outlined above would be advantageous in any one or more of these experiments.

It will be appreciated that various computational parameters (such as any of: the number of iterations; convergence criteria; the refine factor; etc.) of the above methods may be different for different windows. For example, a user may vary such computational parameters to alter the accuracy vs computation balance for different windows of the same overall spectrum.

Modifications

It will be appreciated that in the methods described above where the term "complex amplitude" is used, the imaginary component of said complex amplitude may be zero. In other words a complex amplitude may be real valued. In this case, the phase of such a real valued complex amplitude will be zero if the real value is positive or 7 radians (180 degrees) if the real value is negative.

It is known that, typically, it is important to keep an optimal ion population in an electrostatic trap 80 such as the one described in FIG. 2. Sub-optimal ion populations can result in diminished signal to noise levels or frequency shifts leading to errors in estimations of m/z values. Automatic gain control (AGC) is typically used to try and achieve this optimal ion population (AGC is well-known to the skilled person and described in U.S. Pat. Nos. 6,987,261 and 6,555,814 so, therefore, only briefly described below).

In this procedure, typically, information on the number of charges from a previous scan (this scan might be a dedicated AGC pre-scan), or from the readings of the dedicated detector used to "predict" the accumulation time needed to achieve the optimal ion population. It will therefore be appreciated that any of the methods described above would be well-suited for use in AGC. In particular, any of these methods may be used for the prediction of the total ion population. This prediction may be across the entire mass range. Additionally, or alternatively the prediction may be within selected regions by using windowing as described above.

An example approach may involve a dedicated pre-scan. Typically the pre-scan would have a substantially shorter acquisition time compared the usual mass analysis. The pre-scan may then be used to estimate a current ion flux. This information may be used to control or adjust the ion optics and/or determine the optimal number of charges to be introduced in the detector for mass analysis in any following scans.

Of course, it will be appreciated that in addition to, or instead of a pre-scan, the information on the number of charges may directly be obtained from a mass scan itself by either application of any of the above methods. It should be noted that such information could be obtained in real time. For example, this may be achieved by using only the initial part of the transient (such as data from 1-10% of the entire transient duration). A combinational approach might also be feasible, in which a dedicated pre-scan(s) can be used to roughly "predict" the optimal ion optic setting, whereas current mass spectra are used for fine adjustment.

It will be appreciated that mass-spectrometers 10 such as that shown in FIG. 2 typically must be calibrated correctly to account for systematic frequency and/or intensity shifts. This is because the observed frequencies and intensities of ion oscillations are the only available values which provide direct information about the masses and abundances of the ionic species present. One of the primary factors influencing the trajectories and the speeds of the oscillating ions is the trapping field they experience. The strength and the stability of the experienced trapping field, among other factors, are affected by the space-charge. Be it the total ion population in the detector, the number and the size of the ion packets oscillating with a close enough frequency and proximity to, or the number of charges within a given ion cloud, all these factors affect the field the ions experience and result in the reported frequency and intensity shifts.

It will therefore be recognized that use of the embodiments of the invention outlined above to evaluate the number of charges in the reported frequency spectrum for the purposes of calibration would be beneficial. In particular, the degree of the global space charge is directly related to the entire number of charges, therefore the above methods may be used to evaluate more accurately total ion population across the entire mass range, especially for analysis of proteins. For the local space charge evaluation, windowing can be used, as set out previously, to focus on m/z values or ranges of interest.

The resolving capability (or fidelity measure) of the method 700 and/or the method 900 may depend at least in part upon the local peak density. The local peak density can be thought of as the number of peaks within a given mass window. The resolving capability of the method 700 and/or the method 900 may also depend at least in part upon noise conditions. For example the degree of fidelity with which clusters of peaks are being resolved typically drops as the complexity of clusters increases and/or the noise level increases. The resolving capability may be thought of as the minimum separation between two peaks where the two peaks can be considered to be correctly resolved (to a pre-determined confidence). In other words, peaks separated by less than the resolving capability may be considered to compose the same peak to a pre-determined confidence. The resolving capability may be estimated as a function of any of: frequency separation, signal-to-noise ratio, false detection (or discovery) rate (FDR), local peak density, and so forth. Typically the resolving capability is estimated as a function of FDR. The general concept of the FDR is well known in the art and not discussed further herein, however in this case the FDR may be understood as the proportion of peaks (or m/z values with non-zero intensity) in the calculated mass spectrum which would not match within predefined tolerances to a hypothetical completely accurate version of the same mass spectrum.

Regression tests on simulated data may be used to estimate the resolving capability as a function of FDR. For example, numerical experiments, such as the calculation of ideal mass spectra of known doublet or triplets may be used. Typically, by comparing mass spectra for such doublet or triplets obtained using the methods outlined above with the numerical experiments the resolving capability as a function of FDR may be obtained.

It will be appreciated that further processing may be carried out in relation to the one or more intensity values 396-*n* that may be generated in any of the post processing steps 530 described above. As discussed above, the one or more intensity values 396-*n* may be generated based on one or more complex amplitudes. In particular, an intensity value 396-*n* may be a function of any of: the absolute values of the one or more complex amplitudes, the real values of the one or more complex amplitudes; the imaginary values of the one or more complex amplitudes; etc. For example, an intensity value 396-*n* may be the sum of the absolute values of the one or more complex amplitudes or the sum of the one or more complex amplitudes projected onto an expected phase (such as through phase correction). This further processing is preferably carried out on an already real-valued amplitude spectrum in the frequency domain.

In particular, intensity values 396-*n* (or centroids) separated by less than a threshold m/z value may be formed into a single merged intensity value (or centroid), such as via a weighted average as described previously. The threshold value may be set based on the local peak density and a user specified confidence level. Preferably, the threshold may be set using an estimate of the resolving capability as a function of FDR, as described above. For example, for a given FDR (such as 1%) the estimate of the resolving capability at that FDR would give the threshold value. The intensity values 396-*n* may then be further processed using this threshold value as described above. In effect, this example may be thought of as using the results of regression tests on simulated data to create a new mass spectrum (which could be termed the reported mass spectrum) that reflects a "true" mass spectrum with FDR not more than the specified value.

In another example, the local peak density of the mass spectrum 390 may be determined using a sliding window approach. A minimal frequency distance, for a user specified confidence, corresponding to the local peak density may be determined, such as based on the estimated fidelity measure, above. The threshold value may then be set based on this minimal frequency distance (typically the threshold value will be substantially equal to the minimal frequency distance).

Figure 12:
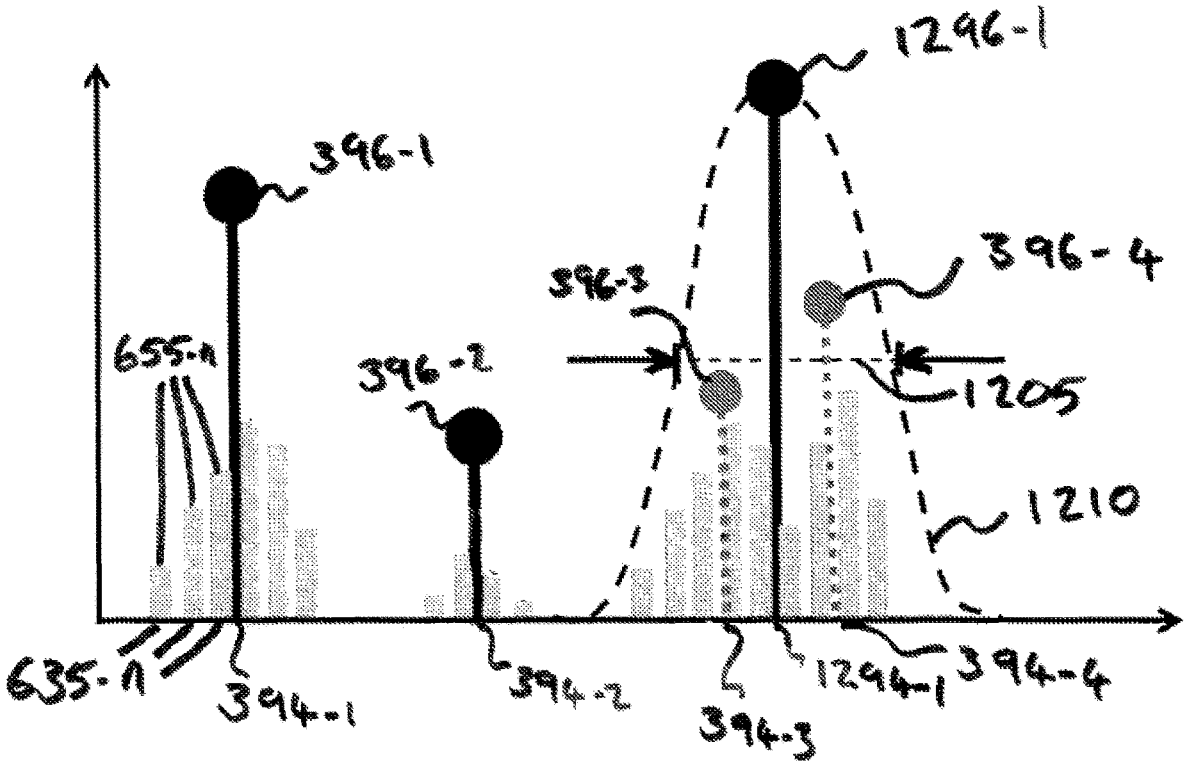
FIG. 12 shows an example mass spectrum before, and after, further processing.

FIG. 12 shows an example mass spectrum before, and after, further processing such as that described above. Prior to the further processing, there are shown a number of centroids with intensity values 396-1; 396-2; 396-3; 396-4. Each intensity value has a corresponding frequency 394-1; 394-2; 394-3; 394-4. The intensity values 396-1; 396-2; 396-3; 396-4 and the frequencies 394-1; 394-2; 394-3; 394-4 are calculated from the complex amplitudes 655-*n* and the frequencies 635-*n* as described previously in relation to FIG. 4D (to aid the clarity of FIG. 12 only the leftmost three complex amplitudes 655-*n* and the leftmost three frequencies 635-*n* have been labelled).

In this particular example the estimated resolving capability for the system used to generate the complex amplitudes 655-*n* and the user specified FDR corresponds to a threshold value 1205 (shown as a frequency width). The centroid corresponding to intensity value 396-3 and the centroid corresponding to intensity value 396-4 are separated by less than this threshold value 1205. In other words, the difference between the frequency 394-3 corresponding to intensity value 396-3 and the frequency 394-4 corresponding to intensity value 396-4 is less than the threshold value 1205. As a result, the further processing replaces (or merges) these two centroids (and therefore the corresponding intensity values 396-3; 396-4 and the corresponding frequencies 394-3; 394-4) with a merged centroid with a new intensity value 1296-1 and a new frequency 1294-1. The new (or merged) intensity value 1296-1 may be the sum of the two intensity values 396-3; 396-4. The new (or merged) frequency 1294-1 may be the average of the two frequencies 394-3; 394-4 (typically weighted with the two intensity values 396-3; 396-4). In this way a reported mass spectrum with FDR not more than the specified value has been formed. It will be appreciated that in this example the "true" mass spectrum might have indeed contained peaks at 394-3 and 394-4. Merging these peaks may still provide an advantage if the probability of erroneous "over-resolving" peaks and giving false positives is too high to be acceptable by instead presenting an under-resolved peak.

Additionally, when a mass spectrum produced by further process such as that described above, is displayed to the user visual indication of merged centroids may be provided. For example a distribution curve centred on a merged centroid (such as the frequency 1294-1 of the merged centroid) may be displayed. An example of such a distribution curve 1210 is shown in FIG. 12. The distribution curve 1210 may be based on any suitable distribution function. Examples of functions that may be used (either alone or in any combination) include: a Gaussian function, a Lorentz function and so on. Typically, the peak height of the distribution curve 1210 is the intensity value 1296-1 of the merged centroid. The width of the distribution curve at half the height of the distribution curve may be set as the threshold value.

In this way a visual representation of the estimated resolving "error" may be presented to the user to allow the user to better understand mass resolution of the mass spectrum.

It will be appreciated that the methods described have been shown as individual steps carried out in a specific order. However, the skilled person will appreciate that these steps may be combined or carried out in a different order whilst still achieving the desired result.

It will be appreciated that embodiments of the invention may be implemented using a variety of different information processing systems. In particular, although the figures and the discussion thereof provide an exemplary computing system and methods, these are presented merely to provide a useful reference in discussing various aspects of the invention. Embodiments of the invention may be carried out on any suitable data processing device, such as a personal computer, laptop, server computer, etc. Of course, the description of the systems and methods has been simplified for purposes of discussion, and they are just one of many different types of system and method that may be used for embodiments of the invention. It will be appreciated that the boundaries between logic blocks are merely illustrative and that alternative embodiments may merge logic blocks or elements, or may impose an alternate decomposition of functionality upon various logic blocks or elements.

It will be appreciated that the above-mentioned functionality may be implemented as one or more corresponding modules as hardware and/or software. For example, the above-mentioned functionality may be implemented as one or more software components for execution by a processor of the system. Alternatively, the above-mentioned functionality may be implemented as hardware, such as on one or more field-programmable-gate-arrays (FPGAs), and/or one or more application-specific-integrated-circuits (ASICs), and/or one or more digital-signal-processors (DSPs), and/or other hardware arrangements. Method steps implemented in flowcharts contained herein, or as described above, may each be implemented by corresponding respective modules; multiple method steps implemented in flowcharts contained herein, or as described above, may be implemented together by a single module.

It will be appreciated that, insofar as embodiments of the invention are implemented by a computer program, then a storage medium and a transmission medium carrying the computer program form aspects of the invention. The computer program may have one or more program instructions, or program code, which, when executed by a computer carries out an embodiment of the invention. The term "program" as used herein, may be a sequence of instructions designed for execution on a computer system, and may include a subroutine, a function, a procedure, a module, an object method, an object implementation, an executable application, an applet, a servlet, source code, object code, a shared library, a dynamic linked library, and/or other sequences of instructions designed for execution on a computer system. The storage medium may be a magnetic disc (such as a hard drive or a floppy disc), an optical disc (such as a CD-ROM, a DVD-ROM or a BluRay disc), or a memory (such as a ROM, a RAM, EEPROM, EPROM, Flash memory or a portable/removable memory device), etc. The transmission medium may be a communications signal, a data broadcast, a communications link between two or more computers, etc.

The invention claimed is:

1. A system for producing a mass spectrum from a time-varying transient signal, the system comprising:

a mass spectrometer including:

an ion source for producing ions from a sample; and a Fourier transform mass analyzer configured to trap the ions within a trapping field and generate a transient signal from the oscillation of the ions within the trapping field;

a processing system for processing the transient signal connected to the mass spectrometer, the processing system including a processor configured to:

receive the transient signal from the mass spectrometer;

perform a Fourier transform of the transient signal to produce a first set of complex amplitudes wherein each of the complex amplitudes corresponds to a respective frequency of a first set of frequencies;

generate a second set of complex amplitudes, wherein each of the complex amplitudes corresponds to a respective frequency of a second set of frequencies, wherein the minimum spacing of the second set of frequencies is less than the inverse of the duration of the transient signal;

optimize the second set of complex amplitudes to produce a third set of complex amplitudes;

generate a mass spectrum from at least some of the third set of complex amplitudes;

wherein optimizing the second set of complex amplitudes to produce the third set of complex amplitudes comprises:

varying at least one of the complex amplitudes of the second set of complex amplitudes based on an objective function to obtain an extremum value of the objective function, wherein the objective function, for each frequency of the first set of frequencies, is a function of one or more complex amplitudes of the second set of complex amplitudes and the respective complex amplitude thereby relating one or more complex amplitudes of the second set of complex amplitudes to the respective complex amplitude from the first set of complex amplitudes, subject to, for at least some of the complex amplitudes of the second set of complex amplitudes, a constraint on the phase of each complex amplitude relative to a frequency-dependent expected phase.

2. The system of claim 1 wherein the step of performing a Fourier transform includes windowing the Fourier-transformed transient signal in the frequency domain, wherein the first set of complex amplitudes correspond to the windowed Fourier-transformed transient signal.

3. The system of claim 2 wherein said windowing comprises applying a windowing function to the first set of complex amplitudes.

4. The system of claim 2 wherein said windowing comprises discarding the complex amplitudes whose respective frequency is outside of one or more pre-defined frequency ranges thereby leaving the first set of complex amplitudes whose respective frequency is within the window.

5. The system of claim 1 wherein the method is performed as part of any one of:

Selected Ion Chromatogram monitoring;

Reconstructed-Ion Chromatogram monitoring;

a Selected Ion Monitoring experiment;

Base Peak Chromatogram monitoring;

a Selected Reaction Monitoring experiment;

a Consecutive Reaction Monitoring experiment;

a Multiple Reaction Monitoring experiment;

a Parallel Reaction Monitoring experiment;

a Panoramic scan experiment;

an $MS^n$ experiment (n=1, 2 . . . );

evaluation of ion current or ion charge for the purpose of adjusting acquisition conditions; and a calibration procedure of the mass spectrometer device.

6. The system of claim 1 wherein the expected phase is based at least in part on any of:

(a) the arrangement of the mass spectrometer;

(b) an ion injection process into the mass spectrometer;

(c) an ion excitation process in the mass spectrometer;

(d) a signal detection method;

(e) a measured phase of one or more harmonic spectral components in the transient; or (f) a measured phase of one or more harmonic spectral components in any transient obtained in this mass spectrometer before or after obtaining the processed transient.

7. The system according to claim 1 wherein the constraint comprises the phase of each complex amplitude to be equal to the expected phase or to be within a range around the expected phase wherein, optionally, the range is based at least in part on the jitter of the mass spectrometer.

8. The system according to claim 1 wherein, for each complex amplitude of the third set of complex amplitudes, the objective function comprises the product of that complex amplitude and the overlap of a respective Fourier basis function corresponding to a complex amplitude of the first set of complex amplitudes and a respective second basis function corresponding to that complex amplitude.

9. The system according to claim 8 wherein the respective second basis function comprises a Fourier basis function.

10. The system according to claim 1 wherein for at least one of the complex amplitudes of the second set of complex amplitudes:

that complex amplitude comprises:

a respective auxiliary complex amplitude corresponding to the respective frequency; and a scaled further complex amplitude, wherein the scaled complex amplitude corresponds to a further frequency of the second set of frequencies, wherein the constraint on the phase of that complex amplitude comprises:

a constraint on the phase of the respective auxiliary complex amplitude relative to a frequency-dependent expected phase.

11. The system according to claim 10 wherein the further complex amplitude is one of:

(a) a complex amplitude from the second set of complex amplitudes; or (b) an auxiliary complex amplitude of a complex amplitude from the second set of complex amplitudes.

12. The system according to claim 10 wherein the respective frequency is a harmonic of the further frequency.

13. The system according to claim 10 wherein said scaling is based at least in part on any of:

(a) the arrangement of one or more electrodes in the mass spectrometer;

(b) the arrangement of the mass spectrometer; or (c) at least part of the respective second basis function.

14. The system according to claim 1 wherein said varying is with the aim of obtaining an extremum value of the objective function.

15. The system according to claim 1 wherein said optimization comprises substantially maximizing a dual function of the objective function.

16. The system according to claim 1 wherein said optimization is based on any of:

(a) an iterative procedure;

(b) Proximal Minimization; or (c) the Alternate Direction Method of Multipliers.

17. A non-transitory computer-readable medium storing a computer program causing a computer to execute a process producing a mass spectrum from a time-varying transient signal detected in a mass spectrometer, the process comprising:

performing a Fourier transform of the transient signal to produce a first set of complex amplitudes wherein each of the complex amplitudes corresponds to a respective frequency of a first set of frequencies;

generating a second set of complex amplitudes, wherein each of the complex amplitudes corresponds to a respective frequency of a second set of frequencies, wherein the minimum spacing of the second set of frequencies is less than the inverse of the duration of the transient signal;

optimizing the second set of complex amplitudes to produce a third set of complex amplitudes;

generating a mass spectrum from at least some of the third set of complex amplitudes;

wherein optimizing the second set of complex amplitudes to produce the third set of complex amplitudes comprises:

varying at least one of the complex amplitudes of the second set of complex amplitudes based on an objective function to obtain an extremum value of the objective function, wherein the objective function, for each frequency of the first set of frequencies, is a function of one or more complex amplitudes of the second set of complex amplitudes and the respective complex amplitude thereby relating one or more complex amplitudes of the second set of complex amplitudes to the respective complex amplitude from the first set of complex amplitudes, subject to, for at least some of the complex amplitudes of the second set of complex amplitudes, a constraint on the phase of each complex amplitude relative to a frequency-dependent expected phase.

18. A method of producing a mass spectrum from a time-varying transient signal detected in a mass spectrometer, the method comprising:

performing a Fourier transform of the transient signal to produce a first set of complex amplitudes wherein each of the complex amplitudes corresponds to a respective frequency of a first set of frequencies;

generating a second set of complex amplitudes, wherein each of the complex amplitudes corresponds to a respective frequency of a second set of frequencies, wherein the minimum spacing of the second set of frequencies is less than the inverse of the duration of the transient signal;

optimizing the second set of complex amplitudes to produce a third set of complex amplitudes;

generating a mass spectrum from at least some of the third set of complex amplitudes;

wherein optimizing the second set of complex amplitudes to produce the third set of complex amplitudes comprises:

varying at least one of the complex amplitudes of the second set of complex amplitudes based on an objective function to obtain an extremum value of the objective function, wherein the objective function, for each frequency of the first set of frequencies, is a function of one or more complex amplitudes of the second set of complex amplitudes and the respective complex amplitude thereby relating one or more complex amplitudes of the second set of complex amplitudes to the respective complex amplitude from the first set of complex amplitudes, subject to, for at least some of the complex amplitudes of the second set of complex amplitudes, a constraint on the phase of each complex amplitude relative to a frequency-dependent expected phase.

19. The method of claim 18 wherein the step of performing a Fourier transform includes windowing the Fourier-transformed transient signal in the frequency domain, wherein the first set of complex amplitudes correspond to the windowed Fourier-transformed transient signal.

20. The method of claim 18 wherein the expected phase is based at least in part on any of:

(a) the arrangement of the mass spectrometer;

(b) an ion injection process into the mass spectrometer;

(c) an ion excitation process in the mass spectrometer;

(d) a signal detection method;

(e) a measured phase of one or more harmonic spectral components in the transient; or (f) a measured phase of one or more harmonic spectral components in any transient obtained in this mass spectrometer before or after obtaining the processed transient.

21. The method according to claim 18 wherein the constraint comprises the phase of each complex amplitude to be equal to the expected phase or to be within a range around the expected phase wherein, optionally, the range is based at least in part on the jitter of the mass spectrometer.

22. The method according to claim 18 wherein, for each complex amplitude of the third set of complex amplitudes, the objective function comprises the product of that complex amplitude and the overlap of a respective Fourier basis function corresponding to a complex amplitude of the first set of complex amplitudes and a respective second basis function corresponding to that complex amplitude.

23. The method according to claim 18 wherein for at least one of the complex amplitudes of the second set of complex amplitudes:

that complex amplitude comprises:

a respective auxiliary complex amplitude corresponding to the respective frequency; and a scaled further complex amplitude, wherein the scaled complex amplitude corresponds to a further frequency of the second set of frequencies, wherein the constraint on the phase of that complex amplitude comprises:

a constraint on the phase of the respective auxiliary complex amplitude relative to a frequency-dependent expected phase.

24. The method according to claim 18 wherein said varying is with the aim of obtaining an extremum value of the objective function.

25. The method according to claim 18 wherein said optimization comprises substantially maximizing a dual function of the objective function.

26. The method according to claim 18 wherein said optimization is based on any of:

(a) an iterative procedure;

(b) Proximal Minimization; or (c) the Alternate Direction Method of Multipliers.

* * * * *